US010833410B2

(12) United States Patent
Ayala Vazquez et al.

(10) Patent No.: US 10,833,410 B2
(45) Date of Patent: Nov. 10, 2020

(54) ELECTRONIC DEVICE ANTENNAS HAVING MULTIPLE SIGNAL FEED TERMINALS

(71) Applicant: Apple Inc., Cupertino, CA (US)

(72) Inventors: Enrique Ayala Vazquez, Watsonville, CA (US); Hongfei Hu, Cupertino, CA (US); Nanbo Jin, San Jose, CA (US); Xu Gao, Santa Clara, CA (US); Erica J. Tong, Pacifica, CA (US); Erdinc Irci, Sunnyvale, CA (US); Han Wang, San Jose, CA (US); Mattia Pascolini, San Francisco, CA (US); Kevin M. Froese, San Francisco, CA (US)

( * ) Notice: Subject to any disclaimer, the term of this patent is extended or adjusted under 35 U.S.C. 154(b) by 350 days.

(21) Appl. No.: 15/902,907

(22) Filed: Feb. 22, 2018

(65) Prior Publication Data

US 2019/0260126 A1 Aug. 22, 2019

(51) Int. Cl.

| | |
|---|---|
| ***H01Q 5/35*** | (2015.01) |
| ***H01Q 9/06*** | (2006.01) |
| ***H01Q 9/04*** | (2006.01) |
| ***H01Q 9/28*** | (2006.01) |

(52) U.S. Cl.

CPC ..... *H01Q 5/35* (2015.01); *H01Q 9/0485* (2013.01); *H01Q 9/065* (2013.01); *H01Q 9/285* (2013.01)

(58) Field of Classification Search

CPC ..... H01Q 1/243; H01Q 5/35; H01Q 9/0485; H01Q 9/065; H01Q 9/285; H01Q 21/30; H01Q 9/42; H01Q 5/328

See application file for complete search history.

(56) References Cited

U.S. PATENT DOCUMENTS

| | | | | |
|---|---|---|---|---|
| 8,798,554 | B2 | 8/2014 | Darnell et al. | |
| 9,276,319 | B2 | 3/2016 | Vazquez et al. | |
| 10,381,710 | B1 * | 8/2019 | Kuo | H01Q 1/2291 |
| 2011/0128190 | A1 * | 6/2011 | Galeev | H01Q 9/0421 343/702 |
| 2012/0112969 | A1 * | 5/2012 | Caballero | H04M 1/0266 343/702 |
| 2015/0188225 | A1 * | 7/2015 | Chang | H01Q 1/243 343/702 |
| 2016/0112219 | A1 | 4/2016 | Lee et al. | |
| 2017/0141469 | A1 | 5/2017 | Huang | |
| 2017/0264721 | A1 | 9/2017 | Yli-Peltola | |

(Continued)

*Primary Examiner* — Graham P Smith
*Assistant Examiner* — Jae K Kim
(74) *Attorney, Agent, or Firm* — Treyz Law Group, P.C.; Michael H. Lyons; Matthew R. Williams

(57) ABSTRACT

An electronic device may include a conductive housing and an antenna. The antenna may include an arm formed from a first segment of the housing. A gap may separate the first segment from a second segment. Respective first and second slots may separate an antenna ground from the first and second segments. The antenna may have a first positive antenna feed terminal on the first segment and a second positive antenna feed terminal on the second segment. A transmission line may include a signal conductor having a first branch coupled to the first positive antenna feed terminal and a second branch coupled to the second positive antenna feed terminal. A switch may be interposed on the second branch for switching the antenna between a first mode in which the second slot is directly fed and a second mode in which the second segment is indirectly fed by the first segment.

20 Claims, 9 Drawing Sheets

(56) References Cited

U.S. PATENT DOCUMENTS

| | | | | |
|---|---|---|---|---|
| 2018/0026349 | A1* | 1/2018 | Lee | H01Q 5/10 455/575.7 |
| 2018/0026353 | A1* | 1/2018 | Tseng | H01Q 13/10 455/575.7 |
| 2018/0062244 | A1* | 3/2018 | Huang | H01Q 1/243 |
| 2018/0191077 | A1* | 7/2018 | Lee | H01Q 1/243 |
| 2018/0248250 | A1* | 8/2018 | Hsu | H04M 1/0283 |
| 2018/0248264 | A1* | 8/2018 | Chen | H01Q 9/40 |

* cited by examiner

ELECTRONIC DEVICE ANTENNAS HAVING MULTIPLE SIGNAL FEED TERMINALS

BACKGROUND

This relates to electronic devices, and more particularly, to antennas for electronic devices with wireless communications circuitry.

Electronic devices often include wireless communications circuitry. For example, cellular telephones, computers, and other devices often contain antennas and wireless transceivers for supporting wireless communications.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover many different cellular telephone communications bands at different frequencies.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies. In addition, it is often difficult to perform wireless communications with a satisfactory data rate (data throughput), especially as software applications performed by wireless devices become increasingly data hungry.

It would therefore be desirable to be able to provide improved wireless communications circuitry for wireless electronic devices.

SUMMARY

An electronic device may be provided with wireless circuitry and a housing having a peripheral conductive housing structures. The wireless circuitry may include an antenna, radio-frequency transceiver circuitry, and one or more radio-frequency transmission lines. The antenna may include an antenna resonating element arm formed from a first segment of the peripheral conductive housing structures that is separated from an antenna ground by a dielectric-filled opening. A dielectric-filled gap in the peripheral conductive housing structures may separate the first segment from a second segment of the peripheral conductive housing structures.

A first slot may separate the antenna ground from the first segment. A second slot may separate the antenna ground from the second segment. The first and second slots may, for example, be formed from continuous portions of the dielectric filled opening (e.g., where the second slot extends from an end of the first slot and beyond an edge of the dielectric-filled gap in the peripheral conductive housing structures). The second slot may have edges defined by the antenna ground and the second segment of the peripheral conductive structures.

The antenna may be fed using an antenna feed having a ground antenna feed terminal and first and second positive antenna feed terminals. The first positive antenna feed terminal may be located on the first segment whereas the second positive antenna feed terminal is located on the second segment. A radio-frequency transmission line may include a ground conductor coupled to the ground antenna feed terminal and a signal conductor having first and second signal conductor branches. The first signal conductor branch may be coupled to the first positive antenna feed terminal. The second signal conductor branch may be coupled to the second positive antenna feed terminal. The second slot may be directly fed using the radio-frequency transmission line over the second signal conductor branch and the second positive antenna feed terminal.

If desired, a switch may be interposed on the second signal conductor branch. When the switch is open, the second segment may be indirectly fed by an end of the first segment and may radiate (e.g., may convey radio-frequency signals) in a first frequency band such as a cellular high band between 2300 MHz and 2700 MHz. When the switch is closed, the second slot may be directly fed and may radiate in the first frequency band (e.g., with greater efficiency towards the upper end of the cellular high band relative to when the switch is open). The first segment may radiate in a second frequency band such as a cellular midband and/or a cellular low-midband regardless of the state of the switch. If desired, an adjustable component may be coupled between the first segment and the antenna ground for adjusting the response of the antenna in the second frequency band.

In one suitable arrangement, the antenna may include an additional antenna feed coupled to an additional radio-frequency transmission line. Control circuitry in the electronic device may selectively activate one of the antenna feeds at a given time. When the additional antenna feed is active, the antenna may operate with optimized antenna efficiency in a third frequency band such as a cellular low band from 600 MHz to 960 MHz, for example. Multiple antennas in the device may be implemented using these structures and may concurrently convey radio-frequency signals at one or more of the same frequencies using a multiple-input and multiple-output (MIMO) scheme if desired.

DETAILED DESCRIPTION

Figure 1:
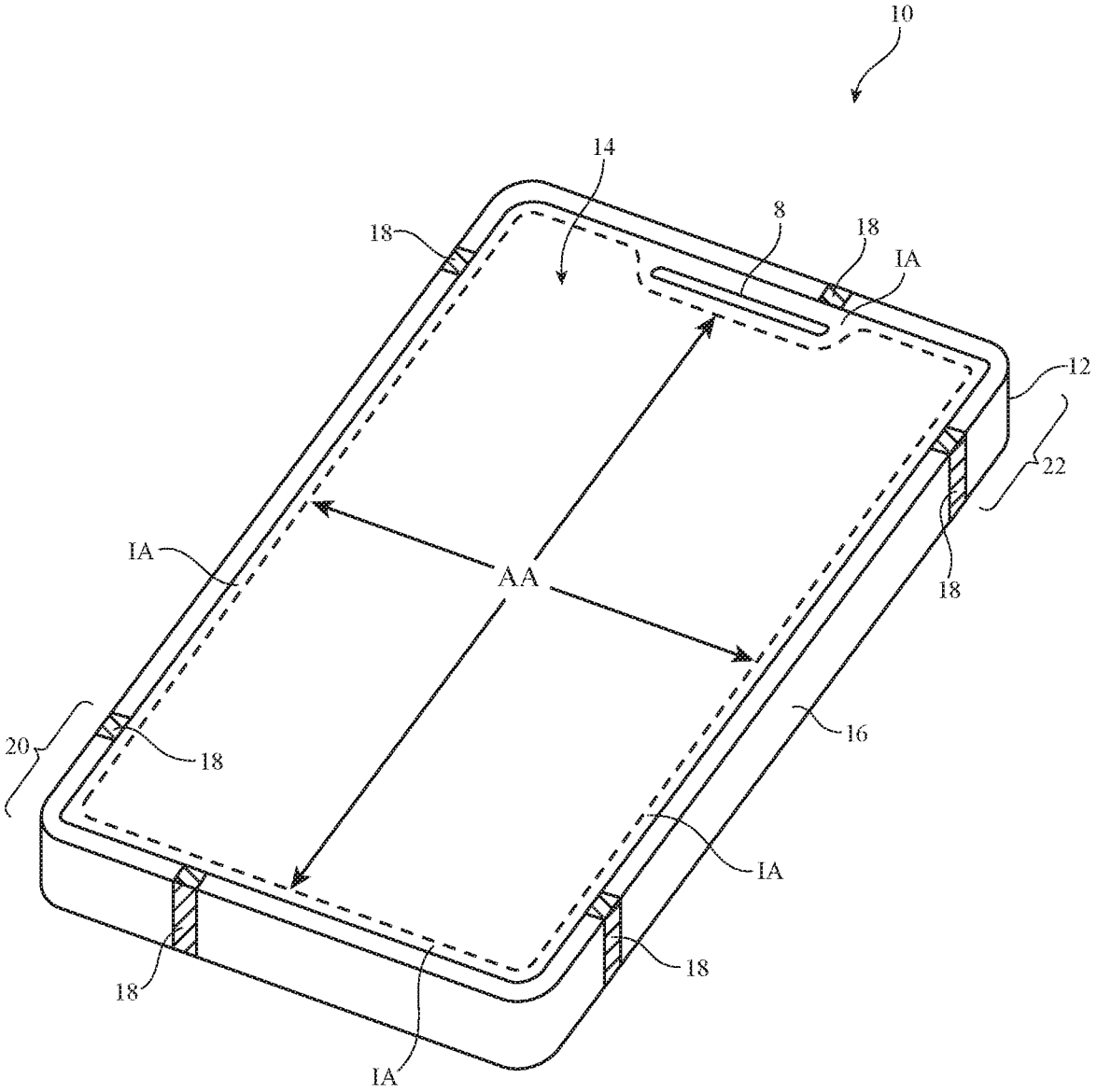
FIG. 1 is a perspective view of an illustrative electronic device in accordance with an embodiment.

Electronic devices such as electronic device 10 of FIG. 1 may be provided with wireless communications circuitry.

The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a rear housing wall (e.g., a planar housing wall). The rear housing wall may have slots that pass entirely through the rear housing wall and that therefore separate housing wall portions (rear housing wall portions and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. If desired, buttons may pass through openings in the cover layer. The cover layer may also have other openings such as an opening for speaker port 8.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, peripheral conductive housing sidewall structures, peripheral conductive housing sidewalls, peripheral conductive sidewalls, or a peripheral conductive housing member (as examples). Peripheral conductive housing structures 16 may be formed from a metal such as stainless steel, aluminum, or other suitable materials. One, two, three, four, five, six, or more than six separate structures may be used in forming peripheral conductive housing structures 16.

It is not necessary for peripheral conductive housing structures 16 to have a uniform cross-section. For example, the top portion of peripheral conductive housing structures 16 may, if desired, have an inwardly protruding lip that helps hold display 14 in place. The bottom portion of peripheral conductive housing structures 16 may also have an enlarged lip (e.g., in the plane of the rear surface of device 10). Peripheral conductive housing structures 16 may have substantially straight vertical sidewalls, may have sidewalls that are curved, or may have other suitable shapes. In some configurations (e.g., when peripheral conductive housing structures 16 serve as a bezel for display 14), peripheral conductive housing structures 16 may run around the lip of housing 12 (i.e., peripheral conductive housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a conductive rear housing wall of device 10 may be formed from a planar metal structure and portions of peripheral conductive housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The conductive rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 and/or the conductive rear wall of housing 12 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of the rear wall of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 16 may be provided with peripheral gap structures. For example, peripheral conductive housing structures 16 may be provided with one or more gaps such as gaps 18, as shown in FIG. 1. The gaps in peripheral conductive housing structures 16 may be filled with dielectric such as polymer, ceramic, glass, air, other dielectric materials, or combinations of these materials. Gaps 18 may divide peripheral conductive housing structures 16 into one or more peripheral conductive segments. There may be, for example, two peripheral conductive segments in peripheral conductive housing structures 16 (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

Figure 2:
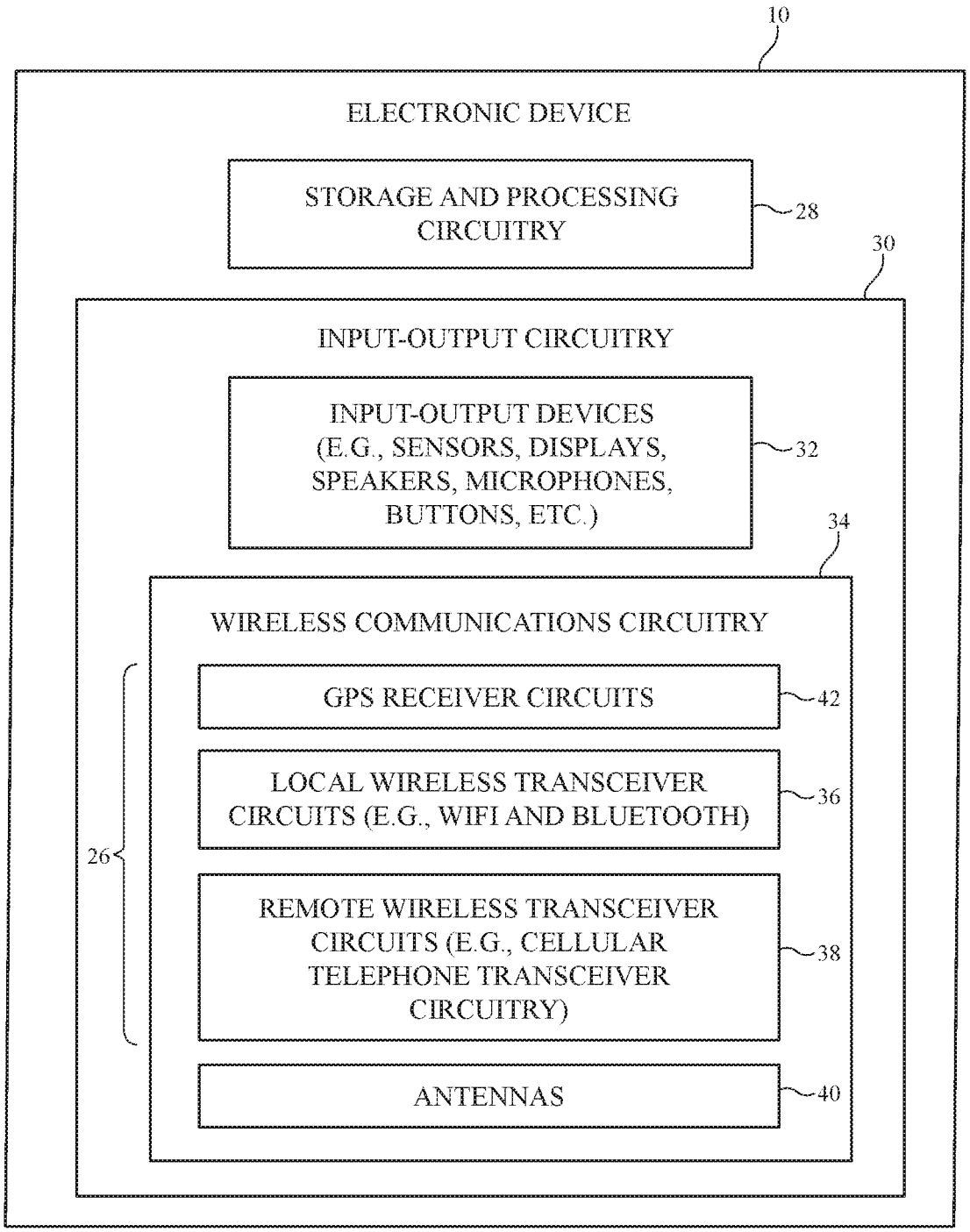
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as Wi-Fi®), protocols for other short-range wireless communications links such as the Bluetooth® protocol, cellular telephone protocols, multiple-input and multiple-output (MIMO) protocols, antenna diversity protocols, near-field communications (NFC) protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 26 for handling various radio-frequency communications bands. For example, circuitry 34 may include transceiver circuitry 36, 38, and 42. Transceiver circuitry 36 may handle 2.4 GHz and 5 GHz bands for Wi-Fi® (IEEE 802.11) communications or communications in other wireless local area network (WLAN) bands and may handle the 2.4 GHz Bluetooth® communications band or other wireless personal area network (WPAN) bands. Circuitry 34 may use cellular telephone transceiver circuitry 38 for handling wireless communications in frequency ranges such as a cellular communications low band from 600 to 960 MHz, a cellular communications low-midband from 1410 to 1510 MHz, a cellular communications midband from 1710 to 2170 MHz, a cellular communications high band from 2300 to 2700 MHz, a cellular communications ultra-high band from 3400 to 3600 MHz, or other communications bands between 600 MHz and 4000 MHz or other suitable frequencies (as examples).

Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
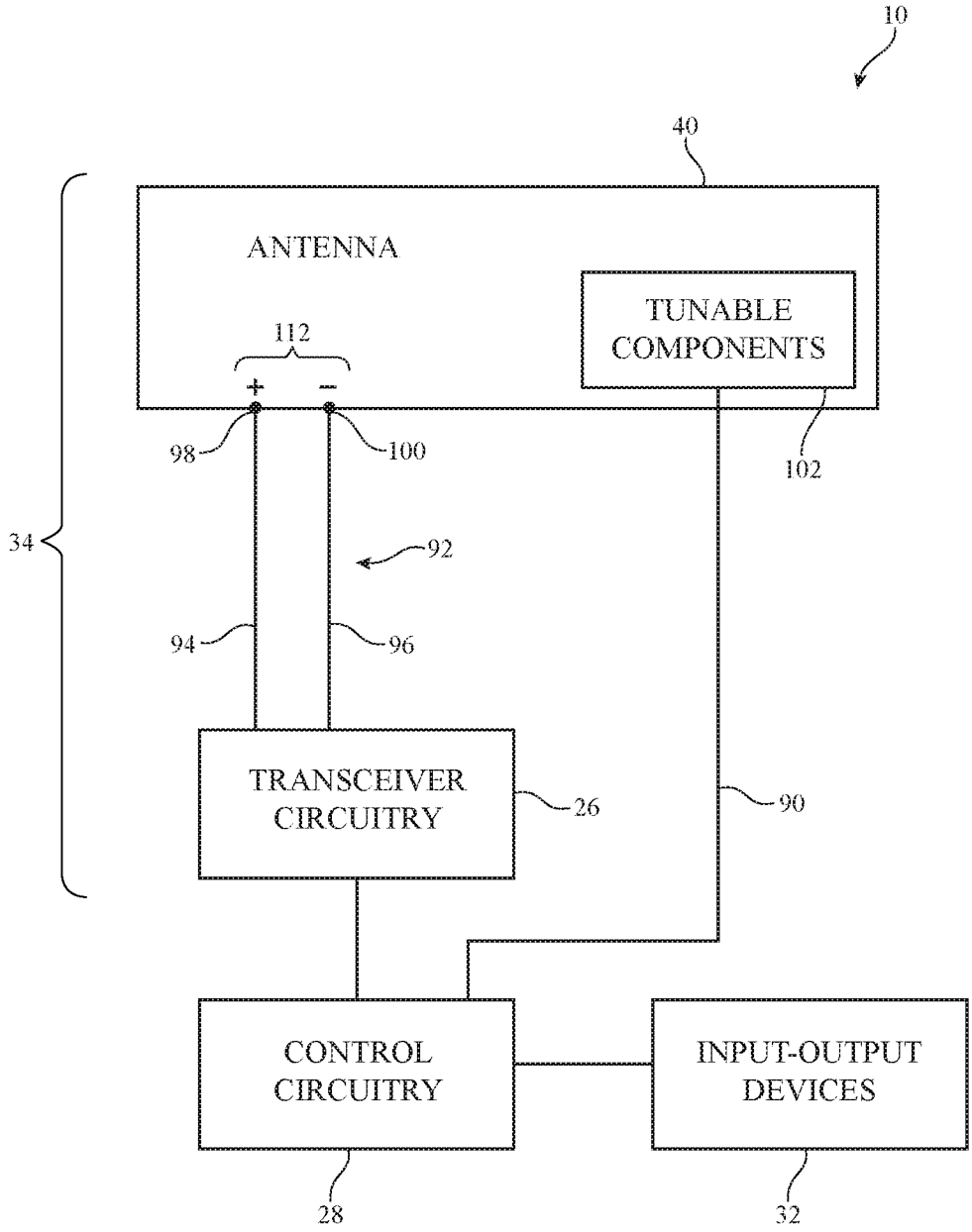
FIG. 3 is a schematic diagram of illustrative wireless communications circuitry in accordance with an embodiment.

As shown in FIG. 3, transceiver circuitry 26 in wireless communications circuitry 34 may be coupled to antenna structures such as a given antenna 40 using paths such as path 92. Wireless communications circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 102 to tune the antenna over communications bands of interest. Tunable components 102 may be part of a tunable filter or tunable impedance matching network, may be part of an antenna resonating element, may span a gap between an antenna resonating element and antenna ground, etc.

Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 90 that adjust inductance values, capacitance values, or other parameters associated with tunable components 102, thereby tuning antenna 40 to cover desired communications bands.

Path 92 may include one or more transmission lines. As an example, path 92 of FIG. 3 may be a transmission line having a positive signal conductor such as line 94 and a ground signal conductor such as line 96. Path 92 may sometimes be referred to herein as transmission line 92 or radio-frequency transmission line 92. Line 94 may sometimes be referred to herein as positive signal conductor 94, signal conductor 94, signal line conductor 94, signal line 94, positive signal line 94, signal path 94, or positive signal path 94 of transmission line 92. Line 96 may sometimes be referred to herein as ground signal conductor 96, ground conductor 96, ground line conductor 96, ground line 96, ground signal line 96, ground path 96, or ground signal path 94 of transmission line 92.

Transmission line 92 may, for example, include a coaxial cable transmission line (e.g., ground conductor 96 may be implemented as a grounded conductive braid surrounding signal conductor 94 along its length), a stripline transmission line, a microstrip transmission line, coaxial probes realized by a metalized via, an edge-coupled microstrip transmission line, an edge-coupled stripline transmission line, a waveguide structure, combinations of these types of transmission lines and/or other transmission line structures, etc.

Transmission lines in device 10 such as transmission line 92 may be integrated into rigid and/or flexible printed circuit boards. In one suitable arrangement, transmission lines such as transmission line 92 may also include transmission line conductors (e.g., signal conductors 94 and ground conductors 96) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 102) may include components such as inductors, resistors, and capacitors used in matching the impedance of antenna 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna 40. As an example, antenna 40 may form an inverted-F antenna, a slot antenna, a hybrid inverted-F slot antenna or other antenna having an antenna feed 112 with a positive antenna feed terminal such as terminal 98 and a ground antenna feed terminal such as ground antenna feed terminal 100. Signal conductor 94 may be coupled to positive antenna feed terminal 98 and ground conductor 96 may be coupled to ground antenna feed terminal 100. Other types of antenna feed arrangements may be used if desired. For example, antenna 40 may be fed using multiple feeds each coupled to a respective port of transceiver circuitry 26 over a corresponding transmission line. If desired, signal conductor 94 may be coupled to multiple locations on antenna 40 (e.g., antenna 40 may include multiple positive antenna feed terminals coupled to signal conductor 94 of the same transmission line 92). The illustrative feeding configuration of FIG. 3 is merely illustrative.

Control circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through speaker 26, information from one or more antenna impedance sensors, information on desired frequency bands to use for communications, and/or other information in determining when antenna 40 is being affected by the presence of nearby external objects or is otherwise in need of tuning. In response, control circuitry 28 may adjust an adjustable inductor, adjustable capacitor, switch, or other tunable components 102 to ensure that antenna 40 operates as desired. Adjustments to tunable components 102 may also be made to extend the frequency coverage of antenna 40 (e.g., to cover desired communications bands that extend over a range of frequencies larger than antenna 40 would cover without tuning).

Antenna 40 may include resonating element structures (sometimes referred to herein as radiating element structures), antenna ground plane structures (sometimes referred to herein as ground plane structures, ground structures, or antenna ground structures), an antenna feed such as feed 112, and other components (e.g., tunable components 102). Antenna 40 may be configured to form any suitable types of antenna. With one suitable arrangement, which is sometimes described herein as an example, antenna 40 is used to implement a hybrid inverted-F-slot antenna that includes both inverted-F and slot antenna resonating elements.

Figure 4:
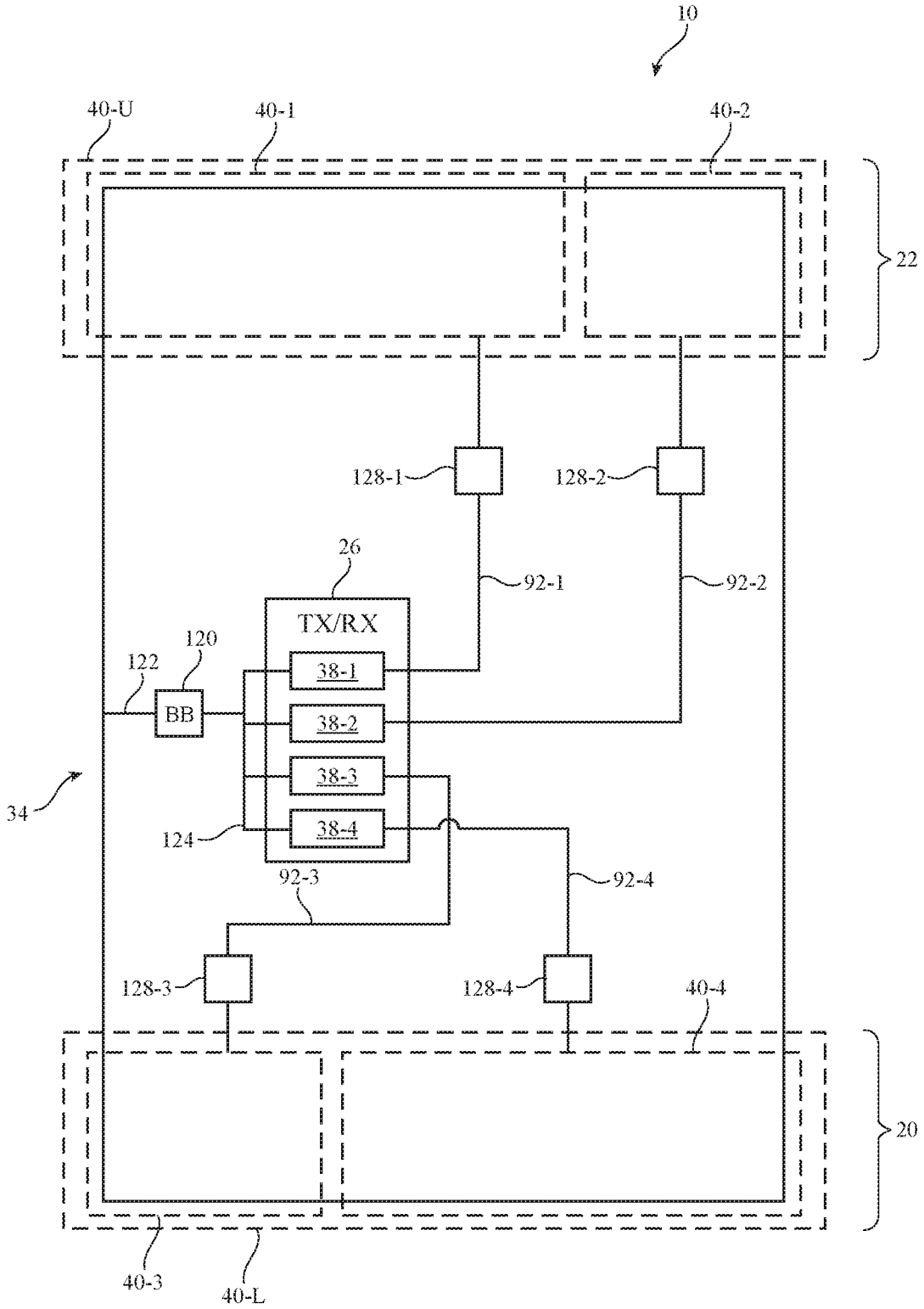
FIG. 4 is a diagram of illustrative wireless circuitry including multiple antennas for performing multiple-input and multiple-output (MIMO) communications in accordance with an embodiment.

If desired, multiple antennas 40 may be formed in device 10. Each antenna 40 may be coupled to transceiver circuitry such as transceiver circuitry 26 over respective transmission lines such as transmission line 92. If desired, two or more antennas 40 may share the same transmission line 92. FIG. 4 is a diagram showing how device 10 may include multiple antennas 40 for performing wireless communications.

As shown in FIG. 4, device 10 may include two or more antennas 40 such as a first antenna 40-1, a second antenna 40-2, a third antenna 40-3, and a fourth antenna 40-4. Antennas 40 may be provided at different locations within housing 12 of device 10. For example, antennas 40-1 and 40-2 may be formed within region 22 at a first (upper) end of housing 12 whereas antennas 40-3 and 40-4 are formed within region 20 at an opposing second (lower) end of housing 12. In the example of FIG. 3, housing 12 has a rectangular periphery (e.g., a periphery having four corners) and each antenna 40 is formed at a respective corner of housing 12. This example is merely illustrative and, in general, antennas 40 may be formed at any desired location within housing 12.

Wireless circuitry 34 may include input-output ports such as port 122 for interfacing with digital data circuits in storage and processing circuitry (e.g., storage and processing circuitry 28 of FIG. 1). Wireless circuitry 34 may include baseband circuitry such as baseband (BB) processor 120 and radio-frequency transceiver circuitry such as transceiver circuitry 26.

Port 122 may receive digital data from storage and processing circuitry that is to be transmitted by transceiver circuitry 26. Incoming data that has been received by transceiver circuitry 26 and baseband processor 120 may be supplied to storage and processing circuitry via port 122.

Transceiver circuitry 26 may include one or more transmitters and one or more receivers. For example, transceiver circuitry 26 may include multiple remote wireless transceivers 38 such as a first transceiver 38-1, a second transceiver 38-2, a third transceiver 38-3, and a fourth transceiver 38-4 (e.g., transceiver circuits for handling voice and non-voice cellular telephone communications in cellular telephone communications bands). Each transceiver 38 may be coupled to a respective antenna 40 over a corresponding transmission line 92 (e.g., a first transmission line 92-1, a second transmission line 92-2, a third transmission line 92-3, and a fourth transmission line 92-4). For example, first transceiver 38-1 may be coupled to antenna 40-1 over transmission line 92-1, second transceiver 38-2 may be coupled to antenna 40-2 over transmission line 92-2, third transceiver 38-3 may be coupled to antenna 40-3 over transmission line 92-3, and fourth transceiver 38-4 may be coupled to antenna 40-4 over transmission line 92-4.

Radio-frequency front end circuits 128 may be interposed on each transmission line 92 (e.g., a first front end circuit 128-1 may be interposed on transmission line 92-1, a second front end circuit 128-2 may be interposed on transmission line 92-2, a third front end circuit 128-3 may be interposed on transmission line 92-3, etc.). Front end circuits 128 may each include switching circuitry, filter circuitry (e.g., duplexer and/or diplexer circuitry, notch filter circuitry, low pass filter circuitry, high pass filter circuitry, bandpass filter circuitry, etc.), impedance matching circuitry for matching the impedance of transmission lines 92 to the corresponding antenna 40, networks of active and/or passive components such as tunable components 102 of FIG. 3, radio-frequency coupler circuitry for gathering antenna impedance measurements, or any other desired radio-frequency circuitry. If desired, front end circuits 128 may include switching circuitry that is configured to selectively couple antennas 40-1, 40-2, 40-3, and 40-4 to different respective transceivers 38-1, 38-2, 38-3, and 38-4 (e.g., so that each antenna can handle communications for different transceivers 38 over time based on the state of the switching circuits in front end circuits 128).

If desired, front end circuits 128 may include filtering circuitry (e.g., duplexers and/or diplexers) that allow the corresponding antenna 40 to transmit and receive radio-frequency signals at the same time (e.g., using a frequency domain duplexing (FDD) scheme). Antennas 40-1, 40-2, 40-3, and 40-4 may transmit and/or receive radio-frequency signals in respective time slots or two or more of antennas 40-1, 40-2, 40-3, and 40-4 may transmit and/or receive radio-frequency signals concurrently. In general, any desired combination of transceivers 38-1, 38-2, 38-3, and 38-4 may transmit and/or receive radio-frequency signals using the corresponding antenna 40 at a given time. In one suitable arrangement, each of transceivers 38-1, 38-2, 38-3, and 38-4 may receive radio-frequency signals while a given one of transceivers 38-1, 38-2, 38-3, and 38-4 transmits radio-frequency signals at a given time.

Amplifier circuitry such as one or more power amplifiers may be interposed on transmission lines 92 and/or formed within transceiver circuitry 26 for amplifying radio-frequency signals output by transceivers 38 prior to transmission over antennas 40. Amplifier circuitry such as one or more low noise amplifiers may be interposed on transmission lines 92 and/or formed within transceiver circuitry 26 for amplifying radio-frequency signals received by antennas 40 prior to conveying the received signals to transceivers 38.

In the example of FIG. 3, separate front end circuits 128 are formed on each transmission line 92. This is merely illustrative. If desired, two or more transmission lines 92 may share the same front end circuits 128 (e.g., front end circuits 128 may be formed on the same substrate, module, or integrated circuit).

Each of transceivers 38 may, for example, include circuitry for converting baseband signals received from baseband processor 120 over path 124 into corresponding radio-frequency signals. For example, transceivers 38 may each include mixer circuitry for up-converting the baseband signals to radio-frequencies prior to transmission over antennas 40. Transceivers 38 may include digital to analog converter (DAC) and/or analog to digital converter (ADC) circuitry for converting signals between digital and analog domains. Each of transceivers 38 may include circuitry for converting radio-frequency signals received from antennas 40 over transmission lines 92 into corresponding baseband signals. For example, transceivers 38 may each include mixer circuitry for down-converting the radio-frequency signals to baseband frequencies prior to conveying the baseband signals to baseband processor 120 over paths 124.

Each transceiver 38 may be formed on the same substrate, integrated circuit, or module (e.g., transceiver circuitry 26 may be a transceiver module having a substrate or integrated circuit on which each of transceivers 38 are formed) or two or more transceivers 38 may be formed on separate substrates, integrated circuits, or modules. Baseband circuitry 120 and front end circuits 128 may be formed on the same substrate, integrated circuit, or module as transceivers 38 or may be formed on separate substrates, integrated circuits, or modules from transceivers 38. In another suitable arrangement, transceiver circuitry 26 may include a single transceiver 38 having four ports, each of which is coupled to a respective transmission line 92, if desired. Each transceiver 38 may include transmitter and receiver circuitry for both transmitting and receiving radio-frequency signals. In another suitable arrangement, one or more transceivers 38 may perform only signal transmission or signal reception (e.g., one or more of circuits 38 may be a dedicated transmitter or dedicated receiver).

In the example of FIG. 4, antennas 40-1 and 40-4 may occupy a larger space (e.g., a larger area or volume within device 10) than antennas 40-2 and 40-3. This may allow antennas 40-1 and 40-4 to support communications at longer wavelengths (i.e., lower frequencies) than antennas 40-2 and 40-3. This is merely illustrative and, if desired, each of antennas 40-1, 40-2, 40-3, and 40-4 may occupy the same volume or may occupy different volumes. Antennas 40-1, 40-2, 40-3, and 40-4 may be configured to convey radio-frequency signals in at least one common frequency band. If desired, one or more of antennas 40-1, 40-2, 40-3, and 40-4 may handle radio-frequency signals in at least one frequency band that is not covered by one or more of the other antennas in device 10.

If desired, each antenna 40 and each transceiver 38 may handle radio-frequency communications in multiple frequency bands (e.g., multiple cellular telephone communications bands). For example, transceiver 38-1, antenna 40-1, transceiver 38-4, and antenna 40-4, may handle radio-frequency signals in a first frequency band such as a low band between 600 and 960 MHz, a second frequency band such as a low-midband between 1410 and 1510 MHz, a third frequency band such as a midband between 1700 and 2200 MHz, a fourth frequency band such as a high band between 2300 and 2700 MHz, and/or a fifth frequency band such as an ultra-high band between 3400 and 3600 MHz. Transceiver 38-2, antenna 40-2, transceiver 38-3, and antenna 40-3 may handle radio-frequency signals in some or all of these bands (e.g., in scenarios where the volume of antennas 40-1 and 40-2 is large enough to support frequencies in the low band).

The example of FIG. 4 is merely illustrative. In general, antennas 40 may cover any desired frequency bands. Transceiver circuitry 26 may include other transceiver circuits such as one or more circuits 36 or 42 of FIG. 2 coupled to one or more antennas 40. Housing 12 may have any desired shape. Antennas 40 may be formed at any desired locations within housing 12. Forming each of antennas 40-1 through 40-4 at different corners of housing 12 may, for example, maximize the multi-path propagation of wireless data conveyed by antennas 40 to optimize overall data throughput for wireless circuitry 34.

When operating using a single antenna 40, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna 40 may not be capable of providing sufficient data throughput for handling the desired device operations.

In order to increase the overall data throughput of wireless circuitry 34, multiple antennas 40 may be operated using a multiple-input and multiple-output (MIMO) scheme. When operating using a MIMO scheme, two or more antennas 40 on device 10 may be used to convey multiple independent streams of wireless data at the same frequency. This may significantly increase the overall data throughput between device 10 and the external communications equipment relative to scenarios where only a single antenna 40 is used. In general, the greater the number of antennas 40 that are used for conveying wireless data under the MIMO scheme, the greater the overall throughput of wireless communications circuitry 34.

However, if care is not taken, radio-frequency signals conveyed in the same frequency band by multiple antennas 40 may interfere with each other, serving to deteriorate the overall wireless performance of circuitry 34. Ensuring that antennas operating at the same frequency are electromagnetically isolated from each other can be particularly challenging for adjacent antennas 40 (e.g., antennas 40-1 and 40-2, antennas 40-3 and 40-4, etc.) and for antennas 40 that have common (shared) structures (e.g., that have resonating elements formed from adjacent or shared conductive portions of housing 12).

In order to perform wireless communications under a MIMO scheme, antennas 40 need to convey data at the same frequencies. If desired, wireless communications circuitry 34 may perform so-called two-stream (2×) MIMO operations (sometimes referred to herein as 2× MIMO communications or communications using a 2× MIMO scheme) in which two antennas 40 are used to convey two independent streams of radio-frequency signals at the same frequency. Wireless communications circuitry 34 may perform so-called four-stream (4×) MIMO operations (sometimes referred to herein as 4× MIMO communications or communications using a 4× MIMO scheme) in which four antennas 40 are used to convey four independent streams of radio-frequency signals at the same frequency. Performing 4× MIMO operations may support higher overall data throughput than 2× MIMO operations because 4× MIMO operations involve four independent wireless data streams whereas 2× MIMO operations involve only two independent wireless data streams. If desired, antennas 40-1, 40-2, 40-3, and 40-4 may perform 2× MIMO operations in some frequency bands and may perform 4× MIMO operations in other frequency bands (e.g., depending on which bands are handled by which antennas). Antennas 40-1, 40-2, 40-3, and 40-4 may perform 2× MIMO operations in some bands concurrently with performing 4× MIMO operations in other bands, for example.

As one example, antennas 40-1 and 40-4 (and the corresponding transceivers 38-1 and 38-4) may perform 2× MIMO operations by conveying radio-frequency signals at the same frequency in a low band (LB) between 600 MHz and 960 MHz. At the same time, antennas 40-1, 40-2, 40-3, and 40-4 may collectively perform 4× MIMO operations by conveying radio-frequency signals at the same frequency in a midband (MB) between 1700 and 2200 MHz and/or at the same frequency in a high band (HB) between 2300 and 2700 MHz (e.g., antennas 40-1 and 40-4 may perform 2× MIMO operations in the low band concurrently with performing 4×MIMO operations in the midband and/or high band). This example is merely illustrative and, in general, any desired number of antennas may be used to perform any desired MIMO operations in any desired frequency bands.

If desired, antennas 40-1 and 40-2 may include switching circuitry that is adjusted by control circuitry (e.g., control circuitry 28 of FIG. 3). Control circuitry 28 may control the switching circuitry in antennas 40-1 and 40-2 to configure antenna structures in antennas 40-1 and 40-2 to form a single antenna 40U in region 22 of device 10. Similarly, antennas 40-3 and 40-4 may include switching circuitry that is adjusted by control circuitry 28. Control circuitry 28 may control the switching circuitry in antennas 40-3 and 40-4 to form a single antenna 40L (e.g., an antenna 40L that includes antenna structures from antennas 40-3 and 40-4) in region 20 of device 10. Antenna 40U may, for example, be formed at an upper end of housing 12 and may therefore sometimes be referred to herein as upper antenna 40U. Antenna 40L may be formed at an opposing lower end of housing 12 and may therefore sometimes be referred to herein as lower antenna 40L. When antennas 40-1 and 40-2 are configured to form upper antenna 40U and antennas 40-3 and 40-4 are configured to form lower antenna 40L, wireless circuitry 34 may perform 2× MIMO operations using antennas 40U and 40L in any desired frequency bands. If desired, control circuitry 28 may toggle the switching circuitry over time to switch wireless circuitry 34 between a first mode in which antennas 40-1, 40-2, 40-3, and 40-4 perform 2× MIMO operations in any desired frequency bands and 4× MIMO operations in any desired frequency bands and a second mode in which antennas 40-1, 40-2, 40-3, and 40-4 are configured to form antennas 40U and 40L that perform 2× MIMO operations in any desired frequency bands.

If desired, wireless communications circuitry 34 may convey wireless data with multiple antennas on one or more external devices (e.g., multiple wireless base stations) in a scheme sometimes referred to as carrier aggregation. When operating using a carrier aggregation scheme, the same antenna 40 may convey radio-frequency signals with multiple antennas (e.g., antennas on different wireless base stations) at different respective frequencies (sometimes referred to herein as carrier frequencies, channels, carrier channels, or carriers). For example, antenna 40-1 may receive radio-frequency signals from a first wireless base station at a first frequency, from a second wireless base station at a second frequency, and a from a third base station at a third frequency. The received signals at different frequencies may be simultaneously processed (e.g., by transceiver 38-1) to increase the communications bandwidth of transceiver 38-1, thereby increasing the data rate of transceiver 38-1. Similarly, antennas 40-1, 40-2, 40-3, and 40-4 may perform carrier aggregation at two, three, or more than three frequencies within any desired frequency bands. This may serve to further increase the overall data throughput of wireless communications circuitry 34 relative to scenarios where no carrier aggregation is performed. For example, the data throughput of circuitry 34 may increase for each carrier frequency that is used (e.g., for each wireless base station that communicates with each of antennas 40-1, 40-2, 40-3, and 40-4).

By performing communications using both a MIMO scheme and a carrier aggregation scheme, the data throughput of wireless communications circuitry 34 may be even greater than in scenarios where either a MIMO scheme or a carrier aggregation scheme is used. The data throughput of circuitry 34 may, for example, increase for each carrier frequency that is used by antennas 40 (e.g., each carrier frequency may contribute 40 megabits per second (Mb/s) or some other throughput to the total throughput of wireless communications circuitry 34). As one example, antennas 40-1 and 40-4 may perform carrier aggregation across three frequencies within each of the cellular low band, midband, and high band and antennas 40-3 and 40-4 may perform carrier aggregation across three frequencies within each of the cellular midband and high band. At the same time, antennas 40-1 and 40-4 may perform 2× MIMO operations in the cellular low band and antennas 40-1, 40-2, 40-3, and 40-4 may perform 4× MIMO operations in one of cellular midband and the cellular high band. In this scenario, with an exemplary throughput of 40 Mb/s per carrier frequency, wireless circuitry 34 may exhibit a throughput of approximately 960 Mb/s. If 4× MIMO operations are performed in both the cellular midband and the cellular high band by antennas 40-1, 40-2, 40-3, and 40-4, wireless communications circuitry 34 may exhibit an even greater throughput of approximately 1200 Mb/s. In other words, the data throughput of wireless communications circuitry 34 may be increased from the 40 Mb/s associated with conveying signals at a single frequency with a single antenna to approximately 1 gigabits per second (Gb/s) by performing communications using MIMO and carrier aggregation schemes using four antennas 40-1, 40-2, 40-3, and 40-4.

These examples are merely illustrative and, if desired, carrier aggregation may be performed in fewer than three carriers per band, may be performed across different bands, or may be omitted for one or more of antennas 40-1 through 40-4. The example of FIG. 4 is merely illustrative. If desired, antennas 40 may cover any desired number of frequency bands at any desired frequencies. More than four antennas 40 or fewer than four antennas 40 may perform MIMO and/or carrier aggregation operations at non-near-field communications frequencies if desired.

Antennas 40 may include slot antenna structures, inverted-F antenna structures (e.g., planar and non-planar inverted-F antenna structures), loop antenna structures, combinations of these, or other antenna structures.

Figure 5:
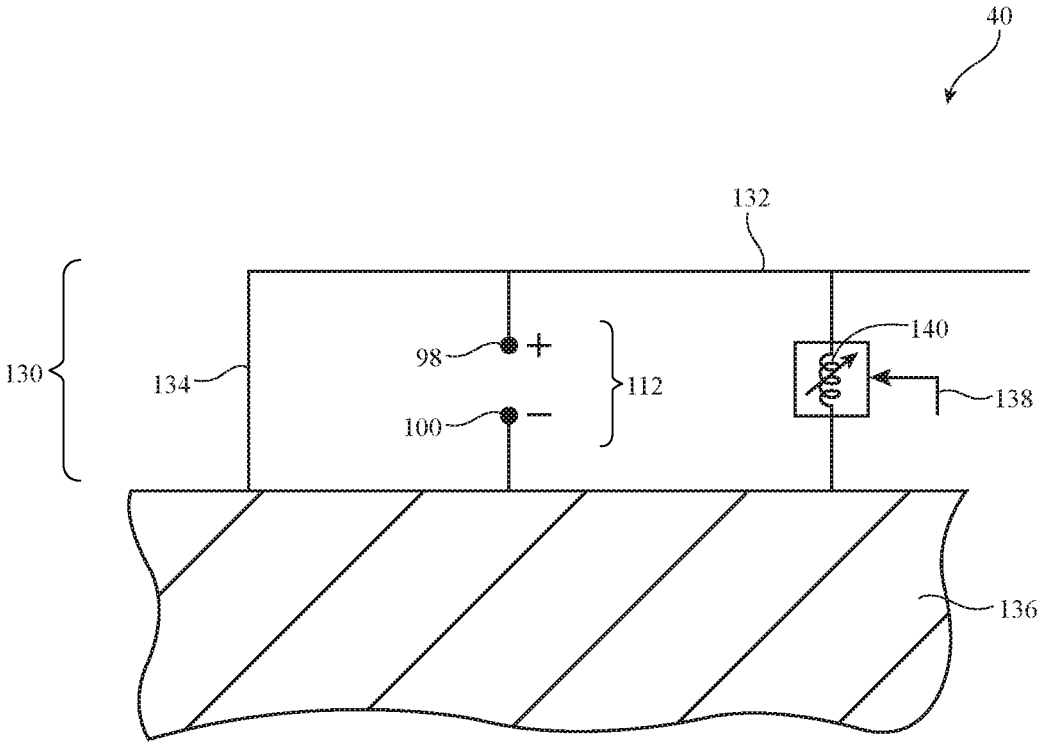
FIG. 5 is a schematic diagram of an illustrative inverted-F antenna in accordance with an embodiment.

An illustrative inverted-F antenna structure is shown in FIG. 5. When using an inverted-F antenna structure as shown in FIG. 5, antenna 40 may include an antenna resonating element 130 (sometimes referred to herein as antenna radiating element 130) and antenna ground 136 (sometimes referred to herein as ground plane 136 or ground 136). Antenna resonating element 130 may have a main resonating element arm such as arm 132. The length of arm 132 may be selected so that antenna 40 resonates at desired operating frequencies. For example, the length of arm 132 (or a branch of arm 132) may be a quarter of a wavelength at a desired operating frequency for antenna 40. Antenna 40 may also exhibit resonances at harmonic frequencies. If desired, slot antenna structures or other antenna structures may be incorporated into an inverted-F antenna such as antenna 40 of FIG. 5 (e.g., to enhance antenna response in one or more communications bands).

Main resonating element arm 132 may be coupled to antenna ground 136 by return path 134. Antenna feed 112 may include positive antenna feed terminal 98 and ground antenna feed terminal 100 and may run parallel to return path 134 between arm 132 and antenna ground 136. If desired, antenna 40 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 132 may have left and right branches that extend outwardly from feed 112 and return path 134. If desired, multiple feeds may be used to feed antennas such as antenna 40. Arm 132 may follow any desired path having any desired shape (e.g., curved and/or straight paths, meandering paths, etc.).

If desired, antenna 40 may include one or more adjustable circuits (e.g., tunable components 102 of FIG. 3) that are coupled to arm 132. As shown in FIG. 5, for example, tunable components 102 such as adjustable inductor 140 may be coupled between antenna resonating element structures in antenna 40 such as arm 132 and antenna ground 136 (i.e., adjustable inductor 140 may bridge the gap between arm 132 and antenna ground 136). Adjustable inductor 140 may exhibit an inductance value that is adjusted in response to control signals 138 provided to adjustable inductor 140 from control circuitry 28 (FIGS. 2 and 3).

Figure 6:
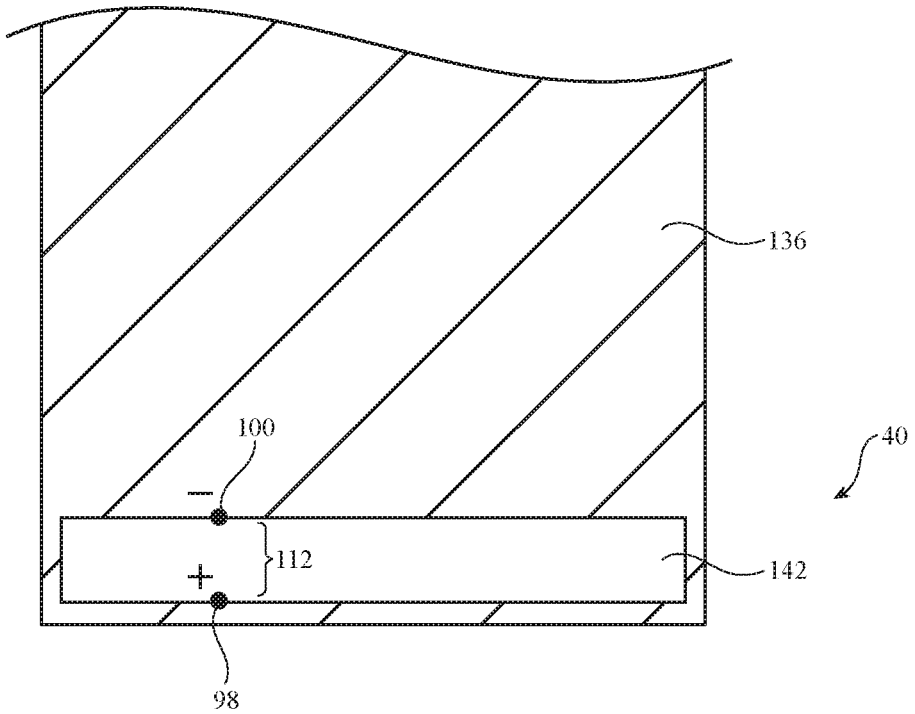
FIG. 6 is a schematic diagram of an illustrative slot antenna in accordance with an embodiment.

Antenna 40 may be a hybrid antenna that includes one or more slot elements. As shown in FIG. 6, for example, antenna 40 may be based on a slot antenna configuration having an opening such as slot 142 that is formed within conductive structures such as antenna ground 136. Slot 142 may be filled with air, plastic, and/or other dielectric. The shape of slot 142 may be straight or may have one or more bends (i.e., slot 142 may have an elongated shape following a meandering path). Feed terminals 98 and 100 may, for example, be located on opposing sides of slot 142 (e.g., on opposing long sides). Slot 142 may sometimes be referred to herein as slot element 142, slot antenna resonating element 142, slot antenna radiating element 142, or slot radiating element 142. Slot-based radiating elements such as slot 142 of FIG. 6 may give rise to an antenna resonance at frequencies in which the wavelength of the antenna signals is equal to the perimeter of the slot. In narrow slots, the resonant frequency of slot 142 is associated with signal frequencies at which the slot length is approximately equal to a half of a wavelength of operation.

The frequency response of antenna 40 can be tuned using one or more tuning components (e.g., components 102 of FIG. 3). These components may have terminals that are coupled to opposing sides of slot 142 (i.e., the tunable components may bridge slot 142). If desired, tunable components may have terminals that are coupled to respective locations along the length of one of the sides of slot 142. Combinations of these arrangements may also be used. If desired, antenna 40 may be a hybrid slot-inverted-F antenna that includes resonating elements of the type shown in both FIG. 5 and FIG. 6 (e.g., having resonances given by both a resonating element arm such as arm 132 of FIG. 5 and a slot such as slot 142 of FIG. 6).

The example of FIG. 6 is merely illustrative. In general, slot 142 may have any desired shape (e.g., shapes with straight and/or curved edges), may follow a meandering path, etc. If desired, slot 142 may be an open slot having one or more ends that are free from conductive material (e.g., where slot 142 extends through one or more sides of antenna ground 136). Slot 142 may, for example, have a length approximately equal to one-quarter of the wavelength of operation in these scenarios.

Figure 7:
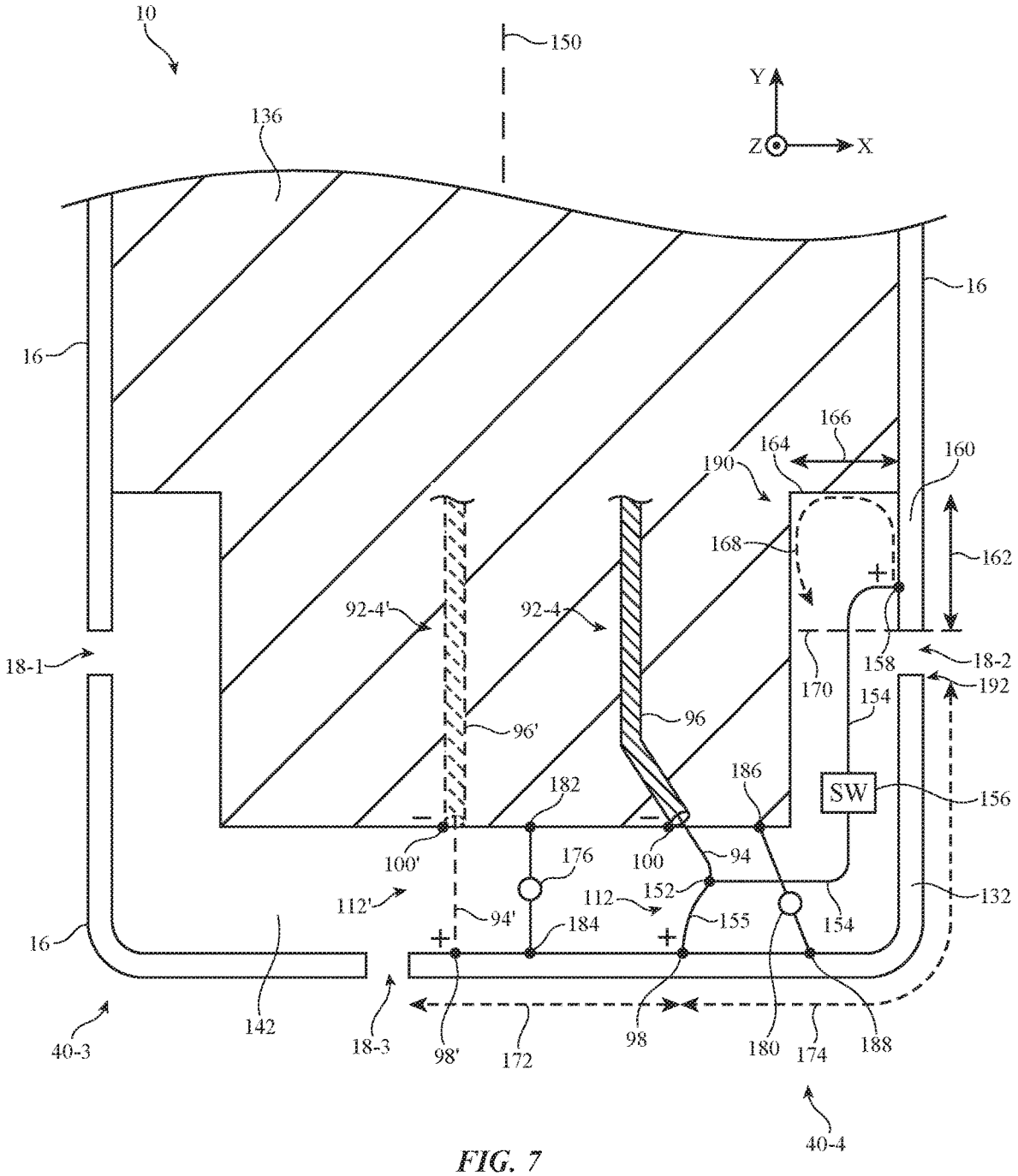
FIG. 7 is a top view of illustrative antenna in an electronic device having multiple signal feed terminals for optimizing radio-frequency performance across multiple different communications bands in accordance with an embodiment.

A top interior view of an illustrative portion of device 10 that contains antenna 40-4 of FIG. 4 is shown in FIG. 7. In the example of FIG. 7, antenna 40-4 is formed using hybrid slot-inverted-F antenna structures that includes resonating elements of the types shown in FIGS. 5 and 6.

As shown in FIG. 7, device 10 may have peripheral conductive housing structures such as peripheral conductive housing structures 16. Peripheral conductive housing structures 16 may be segmented by dielectric-filled gaps (e.g., plastic gaps) 18 such as a first gap 18-1, a second gap 18-2, and a third gap 18-3. Each of gaps 18-1, 18-2, and 18-3 may be formed within peripheral structures 16 along respective sides of device 10.

The resonating element for antenna 40-4 may include an inverted-F antenna resonating element arm such as arm 132 that is formed from a segment of peripheral conductive housing structures 16 extending between gaps 18-3 and 18-2. Air and/or other dielectric may fill slot 142 between arm 132 and antenna ground 136. If desired, opening 142 may be configured to form a slot antenna resonating element structure that contributes to the overall performance of the antenna. Antenna ground 136 may be formed from conductive housing structures, from electrical device components in device 10, from printed circuit board traces, from strips of conductor such as strips of wire and metal foil, or other conductive structures. In one suitable arrangement antenna ground 136 is formed from conductive portions of housing 12 (e.g., portions of a rear wall of housing 12 and portions of peripheral conductive housing structures 16 that are separated from arm 132 by peripheral gaps 18-1 and 18-2) and conductive portions of display 14 (e.g., conductive portions of a display panel, a conductive plate for supporting the display panel, and/or a conductive frame for supporting the conductive plate and/or the display panel).

Antenna 40-4 may be fed using transmission line 92-4. Transmission line 92-4 may include ground conductor 96 and signal conductor 94. In one suitable example, transmission line 92-4 is a coaxial cable having a conductive outer braid that forms ground conductor 96 and having a signal conductor 94 that is surrounded by the conductive outer braid. This is merely illustrative and, in general, any desired transmission line structures having signal conductor 94 and ground conductor 96 may be used.

Transmission line 92-4 may be coupled to antenna feed 112 for antenna 40-4. Positive antenna feed terminal 98 of antenna feed 112 may be coupled to arm 132. Ground antenna feed terminal 100 of antenna feed 112 may be coupled to antenna ground 136 (e.g., antenna feed terminals 100 and 98 may be coupled to opposing sides of slot 142). Signal conductor 94 of transmission line 92-4 may be coupled to positive antenna feed terminal 98 across slot 142. Ground conductor 96 of transmission line 92-4 may be coupled to antenna ground 136. The opposing end of transmission line 92-4 may be coupled to transceiver circuitry 26 (FIG. 4). In one suitable arrangement, transmission line 92-4 may convey cellular telephone signals for transceiver circuitry 26 in one or more of a low band from 600 to 960 MHz, a low-midband from 1410 to 1510 MHz, a midband from 1710 to 2170 MHz, a high band from 2300 to 2700 MHz, and an ultra-high band from 3400 to 3600 MHz.

Antenna ground 136 may have any desired shape within device 10. For example, the lower edge of antenna ground 136 (e.g., the edge coupled of antenna ground 136 coupled to ground antenna feed terminal 100) may be aligned with gaps 18-1 and/or 18-2 in peripheral conductive hosing structures 16 (e.g., the upper or lower edge of gaps 18-1 and/or 18-2 may be aligned with the edge of antenna ground 136 defining slot 142 adjacent to gaps 18-1 and/or 18-2). For example, slot 142 may extend from gap 18-1 to gap 18-2 (e.g., the ends of slot 142 which may sometimes be referred to as open ends, may be formed by gaps 18-1 and 18-2). Slot 142 may have an elongated shape having any suitable length (e.g., about 4-20 cm, more than 2 cm, more than 4 cm, more than 8 cm, more than 12 cm, less than 25 cm, less than 10 cm, etc.) and any suitable width (e.g., approximately 2 mm, less than 2 mm, less than 3 mm, less than 4 mm, 1-3 mm, etc.). Gap 18-3 may be continuous with and extend perpendicular to a portion of slot 142 along the longitudinal axis of the longest portion of slot 142 (e.g., parallel to the X-axis of FIG. 5). Slot 142 may be filled with dielectric such as air, plastic, ceramic, or glass. For example, plastic may be inserted into portions of slot 142 and this plastic may be flush with the outside of housing 12. Dielectric material in slot 142 may lie flush with dielectric material in gaps 18-1, 18-2, and 18-3 at the outside of housing 12 if desired. The example of FIG. 7 in which slot 142 has a U-shape is merely illustrative. If desired, slot 142 may have any other desired shapes (e.g., a rectangular shape, shapes having curved and/or straight edges, etc.).

If desired, as shown in FIG. 7, antenna ground 136 may include a slot such as vertical slot 190 adjacent to gap 18-2 that extends above the edges of gap 18-2 (e.g., along the Y-axis of FIG. 7). A similar vertical slot may be formed adjacent to gap 18-1 if desired.

As shown in FIG. 7, vertical slot 190 adjacent to gap 18-2 may extend beyond the upper edge (e.g., upper edge 170) of gap 18-2 (e.g., in the direction of the Y-axis of FIG. 5). Vertical slot 190 may, for example, have two or more edges that are defined by antenna ground 136 and one edge that is defined by peripheral conductive structures 16 (e.g., the segment of peripheral conductive structures 16 above gap 18-2). Vertical slot 190 may have an open end defined by an open end of slot 142 at gap 18-2. Vertical slot 190 may therefore sometimes be referred to herein as a continuous portion of slot 142, a vertical portion of slot 142, or a vertical extension of slot 142.

Vertical slot 190 may have a width 166 that separates antenna ground 136 from the portion of peripheral conductive structures 16 above gap 18-2 (e.g., in the direction of the X-axis of FIG. 7). Because the portion of peripheral conductive structures 16 above gap 18-2 is shorted to antenna ground 136 (and thus forms part of the antenna ground for antenna 40-4), vertical slot 190 may effectively form an open slot having three sides defined by the antenna ground for antenna 40-4. Vertical slot 190 may have any desired width (e.g., about 2 mm, less than 4 mm, less than 3 mm, less than 2 mm, less than 1 mm, more than 0.5 mm, more than 1.5 mm, more than 2.5 mm, 1-3 mm, etc.). Vertical slot 190 may have an elongated length 162 (e.g., perpendicular to width 166). Vertical slot 190 may have any desired length 162 (e.g., 10-15 mm, more than 5 mm, more than 10 mm, more than 15 mm, more than 30 mm, less than 30 mm, less than 20 mm, less than 15 mm, less than 10 mm, between 5 and 20 mm, etc.). The segment of peripheral conductive housing structures 16 above gap 18-2 that defines an edge of vertical slot 190 may sometimes be referred to herein as segment, portion, or end 160 of peripheral conductive housing structures 16. Segment 160 of peripheral conductive housing structures 16 may have the same length 162 as vertical slot 190, for example.

Electronic device 10 may be characterized by longitudinal axis 150. Length 162 may extend parallel to longitudinal axis 150 (e.g., the Y-axis of FIG. 5). Portions of vertical slot 190 may contribute slot antenna resonances to antenna 40-4 in one or more frequency bands if desired. For example, the length and width of vertical slot 190 (e.g., the perimeter of vertical slot 190) may be selected so that antenna 40-4 resonates at desired operating frequencies. If desired, the overall length of slots 142 and 190 may be selected so that antenna 40 resonates at desired operating frequencies.

A return path for antenna 40-4 such as return path 134 of FIG. 5 may be formed by one or more fixed conductive paths bridging slot 142 and/or one or more adjustable components such as adjustable components 176 and/or 180 as shown in FIG. 7 (e.g., adjustable components such as tunable components 102 of FIG. 3). Adjustable components 176 and 180 may sometimes be referred to herein as tuning components, tunable components, tuning circuits, tunable circuits, adjustable components, or adjustable tuning components.

Adjustable component 176 may bridge slot 142 at a first location along slot 142 (e.g., component 176 may be coupled between terminal 182 on antenna ground 136 and terminal 184 on peripheral conductive structures 16). Adjustable component 180 may bridge slot 142 at a second location along slot 142 (e.g., component 180 may be coupled between terminal 186 on antenna ground 136 and terminal 188 on peripheral conductive structures 16). Ground antenna feed terminal 100 may be interposed between terminal 182 and terminal 186 on antenna ground 136. Positive antenna feed terminal 98 may be interposed between terminal 184 and terminal 188 on peripheral conductive housing structures 16. Terminal 184 may be interposed between gap 18-3 and positive antenna feed terminal 98 on peripheral conductive housing structures 16. Terminal 188 may be interposed between positive antenna feed terminal 98 and gap 18-2 on peripheral conductive housing structures 16.

Components 176 and 180 may include switches coupled to fixed components such as inductors for providing adjustable amounts of inductance, a short circuit, and/or an open circuit between antenna ground 136 and peripheral conductive structures 16. Components 176 and 180 may also include fixed components that are not coupled to switches or a combination of components that are coupled to switches and components that are not coupled to switches. These examples are merely illustrative and, in general, components 176 and 180 may include other components such as adjustable return path switches, switches coupled to capacitors, or any other desired components.

The length of arm 132 of antenna 40-4 may be selected so that antenna 40-4 radiates at desired frequencies such as frequencies in a cellular low band (e.g., a frequency band between about 600 MHz and 960 MHz), a cellular low-midband (e.g., a frequency band between about 1410 MHz and 1510 MHz), a cellular midband (e.g., a frequency band between about 1710 MHz and 2170 MHz), and a cellular ultra-high band (e.g., a frequency band between about 3400 MHz and 3600 MHz).

As an example, the frequency response of antenna 40-4 in the cellular low-midband, the cellular midband, and the cellular ultra-high band may be associated with the distance along arm 132 between return path positive antenna feed terminal 98 and gap 18-2 (as shown by dashed line 174). For example, the response of antenna 40-4 in the cellular low-midband and the cellular midband may be supported by a fundamental mode of arm 132 between positive antenna feed terminal 98 and gap 18-2. The response of antenna 40-4 in the cellular ultra-high band may be supported by a harmonic mode of arm 132 between positive antenna feed terminal 98 and gap 18-2. The frequency response of antenna 40-4 in the cellular low band may be associated with the distance along arm 132 between positive antenna feed terminal 98 and gap 18-3 (as shown by dashed line 172).

Adjustable component 180 may be adjusted to tune the frequency response of antenna 40-4 within the cellular low-midband and/or the cellular midband. As one example, adjustable component 180 may have a first state at which antenna 40-4 only covers the cellular midband and a second state at which antenna 40-4 also covers the cellular low-midband. Adjustable component 180 may form a first impedance (e.g., a short circuit) between terminal 186 and terminal 188 in the first state and second impedance (e.g., an open circuit) between terminals 186 and 188 in the second state, for example. Forming an open circuit with adjustable component 180 may, for example, extend the effective length of the portion of arm 132 thereby extending the response of antenna 40-4 to lower frequencies such as into the cellular low-midband. This example is merely illustrative and, in general, adjustable component 180 may perform any desired frequency adjustments for antenna 40. Adjustable component 176 may be adjusted to tune the frequency response of antenna 40-4 within the cellular low band.

In the example of FIG. 7, the distance between positive antenna feed terminal 98 and gap 18-2 is depicted as being longer than the distance between positive antenna feed terminal 98 and gap 18-3 to more clearly show the components of antenna 40-4. However, in practice, the distance between positive antenna feed terminal 98 and gap 18-3 is longer than the distance between positive antenna feed terminal 98 and gap 18-2 (e.g., because lower frequencies and thus longer wavelengths are supported by the length of arm 132 between positive antenna feed terminal 98 and gap 18-3 than the length of arm 132 between positive antenna feed terminal 98 and gap 18-2).

Segment 160 of peripheral conductive housing structures 16 may contribute to the frequency response of antenna 40-4 in the cellular high band. For example, end 192 of arm 132 at gap 18-2 may indirectly feed segment 160 via near-field electromagnetic coupling (e.g., across gap 18-2). Antenna currents on arm 132 may induce corresponding antenna currents on segment 160 via the near-field electromagnetic coupling. Length 162 may be selected to support a frequency response for antenna 40-4 in the cellular high band (e.g., length 162 may be about one-quarter of a wavelength of operation within the cellular high band). When segment 160 is indirectly fed antenna signals in this way, segment 160 may form a parasitic antenna resonating element for antenna 40-4 (e.g., a radiating element that is not directly fed using antenna feed 112).

In practice, indirectly feeding segment 160 may allow antenna 40-4 to cover some but not all of the cellular high band with satisfactory antenna efficiency. If desired, the frequency response of antenna 40-4 in the cellular high band may be optimized by directly feeding vertical slot 190.

In order to directly feed vertical slot 190, the signal conductor for transmission line 92-4 may have a branched structure that allows the signal conductor to be directly connected to both arm 132 and segment 160. As shown in FIG. 7, signal conductor 94 of transmission line 92-4 may include a first signal conductor branch 155 coupled to positive antenna feed terminal 98 and a second signal conductor branch 154 coupled to (e.g., directly connected to) positive antenna feed terminal 158 on segment 160 of peripheral conductive housing structures 16. Second signal conductor branch 154 and first signal conductor branch 155 of signal conductor 92 may meet at node 152 on signal conductor 92 (e.g., signal conductor branch 154 may be coupled to signal conductor branch 155 at node 152).

Antenna currents may be conveyed over both signal conductor branch 155 to arm 132 and signal conductor branch 154 to segment 160 of peripheral conductive housing structures 16. In this way, antenna feed 112 and thus antenna 40-4 may have two positive antenna feed terminals (i.e., positive antenna feed terminals 98 and 158) that are coupled to peripheral conductive housing structures 16 on opposing sides of gap 18-2.

Antenna currents conveyed over signal conductor branch 154 may be directly fed to vertical slot 190 (e.g., over positive antenna feed terminal 158) and may flow around the perimeter of vertical slot 190 (as shown by dashed path 168). Antenna currents flowing along path 168 may contribute a slot antenna resonance for antenna 40-4 within the cellular high band. The perimeter of vertical slot 190 (i.e., length 162, width 166, and thus the length of path 168) may be selected so that vertical slot 190 contributes a frequency response for antenna 40-4 at desired frequencies within the cellular high band. For example, the perimeter of vertical slot 190 (e.g., the length of path 168) may be about one-half of the wavelength of operation within the cellular high band.

Directly feeding vertical slot 190 in this way may optimize the frequency response of antenna 40-4 in the cellular high band relative to scenarios where segment 160 is only indirectly fed by end 192 of arm 132 (e.g., because vertical slot 190 offers a greater antenna area/aperture for covering the cellular high band than segment 160). For example, directly feeding vertical slot 190 may pull the overall frequency response of antenna 40-4 to higher frequencies within the cellular high band and may increase the overall antenna efficiency of antenna 40-4 within the cellular high band than when segment 160 is only indirectly fed. However, pulling the frequency response to higher frequencies by directly feeding vertical slot 190 in this way may deteriorate the frequency response of antenna 40-4 at other frequencies such as in the cellular low-midband.

If desired, storage and processing circuitry 28 (FIG. 3) may control antenna 40-4 to between a first mode at which segment 160 is indirectly fed and a second mode at which vertical slot 190 is directly fed for covering the cellular high band. For example, switching circuitry such as switch 156 may be interposed on signal conductor branch 156. Switch 156 may, for example, be a single-pole single-throw (SPST) switch. Switch 156 may be turned on (closed) or turned off (opened) based on control signals received from storage and processing circuitry 28 (FIG. 3).

When switch 156 is turned off, an open circuit is formed between node 152 (signal conductor branch 155) and positive antenna feed terminal 158. Antenna 40-4 is directly fed at a single point on arm 132 (e.g., positive antenna feed terminal 98). Segment 160 of peripheral conductive housing structures 16 is indirectly fed by end 192 of arm 132 via near-field electromagnetic coupling. Antenna 40-4 may exhibit a satisfactory antenna efficiency (e.g., an antenna efficiency greater than a predetermined threshold) for only some of the frequency in the cellular high band but may also exhibit satisfactory antenna efficiency at relatively low frequencies such as frequencies in the low-midband.

When switch 156 is turned on, node 152 is shorted to positive antenna feed terminal 158 (e.g., a short circuit path is formed between signal conductor branch 155 and positive antenna feed terminal 158). Antenna 40-4 is directly fed by transmission line 94 at two locations (e.g., positive antenna feed terminal 98 on arm 132 and positive antenna feed terminal 158 on segment 160 of peripheral conductive housing structures 16). Vertical slot 190 is thereby directly fed over signal conductor branch 154 and positive antenna feed terminal 158. Antenna 40-4 may exhibit a satisfactory antenna efficiency for the entirety of the cellular high band (e.g., at higher frequencies than when switch 156 is turned off) but may also exhibit unsatisfactory antenna efficiency (e.g., an antenna efficiency less than a predetermined threshold) at relatively low frequencies such as frequencies in the low-midband.

If desired, control circuitry 20 (FIG. 3) may adjust switch 156 in real time to tune the frequency response of antenna 40-4 based on the needs and/or operating environment of device 10. For example, control circuitry 20 may turn switch 156 off when antenna 40-4 is assigned a frequency in the cellular low-midband or when communications in the cellular low-midband is otherwise prioritized over communications in the cellular high band (e.g., by software running on device 10 or by external equipment such as a cellular base station). Control circuitry 20 may turn switch 156 on when antenna 40-4 is assigned a frequency in the cellular high band (e.g., at relatively high frequencies in the cellular high band) or when communications in the cellular high band is otherwise prioritized over communications in the cellular low-midband. In this way, control circuitry 20 may dynamically adjust the number of positive antenna feed terminals that are used to feed antenna 40-4 using a single transmission line 92-4 in real time (e.g., to optimize wireless performance of antenna 40-4 in desired frequency bands).

In another suitable arrangement, control circuitry 20 may adjust component 180 to extend the frequency response of antenna 40-4 to frequencies in the cellular low-midband when antenna 40-4 is fed using both positive antenna feed terminals 98 and 158 (e.g., when switch 156 is turned on). As an example, adjustable component 180 may be controlled to form an open circuit (infinite impedance) between terminals 186 and 188 to pull the frequency response of antenna 40-4 to frequencies in the cellular low-midband. Adjustable component 180 may, for example, pull the response of antenna 40-4 to frequencies in the cellular low-midband without substantially affecting the response of antenna 40-4 in the cellular high band (e.g., because adjustable component 180 bridges slot 142 and does not overlap vertical slot 190). In this scenario, switch 156 may be omitted if desired.

Feeding antenna 40-4 using antenna feed 112 may limit the length of arm 132 that is used to cover the cellular low band. This may limit the overall antenna efficiency of antenna 40-4 in the cellular low band. If desired, antenna 40-4 may include an additional antenna feed 112' coupled to an additional transmission line 92-4'.

Additional antenna feed 112' may include a positive antenna feed terminal 98' coupled to arm 132 and a ground antenna feed terminal 100' coupled to antenna ground 136. Terminal 182 of adjustable component 176 may, for example, be interposed between ground antenna feed terminal 100' and ground antenna feed terminal 100 on antenna ground 136. Positive antenna feed terminal 98' may be interposed between terminal 184 and gap 18-3 on peripheral conductive housing structures 16. Transmission line 92-4' may include a signal conductor 94' coupled to positive antenna feed terminal 98' across slot 142 and a ground conductor 96' coupled to ground antenna feed terminal 100'.

Control circuitry may control wireless communications circuitry 34 to perform wireless communications over antenna 40-4 using a selected one of transmission lines 92-4' and 92-4 at a given time (e.g., using a selected one of antenna feeds 112' and 112). For example, switching circuitry may couple transmission lines 92-4' and 92-4 to transceiver circuitry 26 (FIG. 2). The switching circuitry may have a first state at which transmission line 92-4' and antenna feed 112' are active (e.g., coupled to transceiver circuitry 26) and at which transmission line 92-4 and antenna feed 112 are inactive (e.g., decoupled from transceiver circuitry 26). The switching circuitry may have a second state at which transmission line 92-4' and antenna feed 112' are inactive and at which transmission line 92-4 and antenna feed 112 are active.

When antenna feed 112' is active, the length of arm 132 between positive antenna feed terminal 98' and gap 18-2 may support a frequency response of antenna 40-4 within the cellular low band. This length is greater than the length of arm 132 that supports frequencies in the cellular low band when antenna feed 112 is active (e.g., the length of arm 132 between positive antenna feed terminal 98 and gap 18-3). Providing a greater length of arm 132 for covering the cellular low band (e.g., when feed 112' is active) may increase the overall antenna efficiency and bandwidth of antenna 40-4 within the cellular low band relative to scenarios where feed 112 is active. Adjustable component 176 may be used to adjust the frequency response of antenna 40-4 within the cellular low band regardless of which feed is active if desired.

Control circuitry 20 (FIG. 3) may select a given one of antenna feeds 112 and 112' to use in real time to tune the frequency response of antenna 40-4 based on the needs and/or operating environment of device 10. For example, control circuitry 20 activate feed 112' and deactivate feed 112 when antenna 40-4 is assigned a frequency in the cellular low band or when communications in the cellular low band is otherwise prioritized over communications in other bands (e.g., by software running on device 10 or by external equipment such as a cellular base station). Control circuitry 20 may activate feed 112 and deactivate feed 112' when antenna 40-4 is assigned a frequency higher than the cellular low band or when communications in frequencies higher than the cellular low band are otherwise prioritized.

In this way, control circuitry 20 may dynamically adjust both the number of positive antenna feed terminals that are used to feed antenna 40-4 using a single transmission line 92-4 and the antenna feed (transmission line) that is used to feed antenna 40-4 in real time (e.g., to optimize wireless performance of antenna 40-4 in desired frequency bands). In scenarios where switch 156 and antenna feed 112' are formed in antenna 40-4, control circuitry 20 may adjust antenna 40-4 so that one or two of three possible positive antenna feed terminals are used to feed antenna 40-4 at any given time. For example, control circuitry 20 may configure antenna 40-4 to be fed using a single positive antenna feed terminal by either activating antenna feed 112' (while antenna feed 112 is deactivated) or by activating antenna feed 112 while antenna feed 112 is deactivated and while switch 156 is turned off. Control circuitry 20 may configure antenna 40-4 to be fed using two antenna feed terminals by activating antenna feed 112 while antenna feed 112' is deactivated and while switch 156 is turned on.

Switch 156, signal conductor branch 154, signal conductor branch 155, adjustable component 176, and/or adjustable component 180 may overlap slot 142 if desired. Switch 156, signal conductor branch 154, signal conductor branchy 155, adjustable component 176, and/or adjustable component 180 may be formed between peripheral conductive housing structures 16 and antenna ground 136 using any desired structures. For example, adjustable component 176, adjustable component 180, switch 156, signal conductor branch 155, and/or signal conductor branch 154 may be formed on a printed circuit such as a flexible printed circuit board that is coupled between peripheral conductive housing structures 16 and antenna ground 136.

Antenna ground 136 may include a conductive layer of housing 12 (e.g., a conductive backplate for device 10). If desired, additional conductive layers may be used to form portions of antenna ground 136. For example, antenna ground 136 may include conductive portions of display 14 of FIG. 1 (e.g., conductive portions of a display panel, a conductive plate for supporting the display panel, and/or a conductive frame for supporting the conductive plate and/or the display panel). Grounded terminals 100', 182, 100, and/or 186 may be coupled to the conductive layer of housing 12, the conductive portion of display 14, or other conductive structures that form antenna ground 136. If desired, conductive structures such as vertical conductive interconnect structures (e.g., a bracket, clip, spring, pin, screw, solder, weld, conductive adhesive, wire, metal strip, etc.) may be used to short the conductive layer of housing 12 to the conductive portion of display 14 that forms a part of antenna ground 136 (e.g., at the locations of terminals 100', 182, 100, and/or 186). Electrically connecting different components of the device ground (e.g., antenna ground 136 in FIG. 7) with vertical conductive interconnect structures may ensure that the conductive structures that are located the closest to resonating element arm 132 are held at a ground potential and form a part of antenna ground 136. This may serve to optimize the antenna efficiency of antenna 40, for example. Conductive interconnect structures such as brackets, clips, springs, pins, screws, solders, welds, conductive adhesive, etc. may be used to couple terminals 98', 184, 98, 188, and/or 158 to peripheral conductive housing structures 16.

The example of FIG. 7 is merely illustrative. In one suitable arrangement, antenna feed 112', transmission line 92-4', and switch 156 may be omitted. In another suitable arrangement, antenna feed 112' may be omitted. In yet another suitable arrangement, adjustable component 180 may be omitted. In still another suitable arrangement, adjustable component 180 and switch 156 may be omitted. In general, any desired combination of antenna feed 112' (and thus transmission line 92-4'), adjustable component 176, adjustable component 180, and switch 156 may be omitted. Additional adjustable components may be coupled between arm 132 and antenna ground 136, between different portions of antenna ground 136, between antenna ground 136 and 136 and segment 160, across gap 18-3, across gap 18-2, and/or between different portions of arm 132 if desired.

While the example of FIG. 7 shows antenna structures for implementing antenna 40-4 in device 10, these structures may be used to implement any one of antennas 40-1, 40-2, 40-3, or 40-4 of device 10 (FIG. 4) and/or may be used to implement any desired antennas 40 in device 10. If desired, the structures used to implement antenna 40-4 of FIG. 7 may be used to implement more than one of antennas 40-2, 40-3, and 40-1 of device 10 (FIG. 4). In this way, any frequency adjustments performed to antenna 40-4 may also be performed (e.g., simultaneously or concurrently) on the other antennas 40 in device 10 for covering the same frequency bands under a MIMO scheme. In one suitable arrangement, antennas 40-1 and 40-4 may both be implemented using the antenna structures of antenna 40-4 of FIG. 7 (e.g., for performing at least 2× MIMO communications in some bands and optionally 4× MIMO communications with antennas 40-2 and 40-3 in other bands). In another suitable arrangement, each of antennas 40-1, 40-2, 40-3, and 40-4 may be implemented using the antenna structures of antenna 40-4 (e.g., for performing 4× MIMO communications in each frequency band).

Antenna 40-3 of FIG. 4 may, if desired, include an antenna resonating element formed from the segment of peripheral conductive housing structures 16 extending between gaps 18-1 and 18-3 of FIG. 7 (e.g., using the same antenna structures as antenna 40-4 of FIG. 7 or using other antenna structures). In these scenarios, gap 18-3 may provide mechanical separation between arms 132 of antenna 40-4 and the antenna resonating element of antenna 40-3. This mechanical separation may serve to electromagnetically isolate antenna 40-3 from antenna 40-4 when antennas 40-3 and 40-4 operate at the same frequency (e.g., for performing communications using a MIMO scheme).

Figure 8:
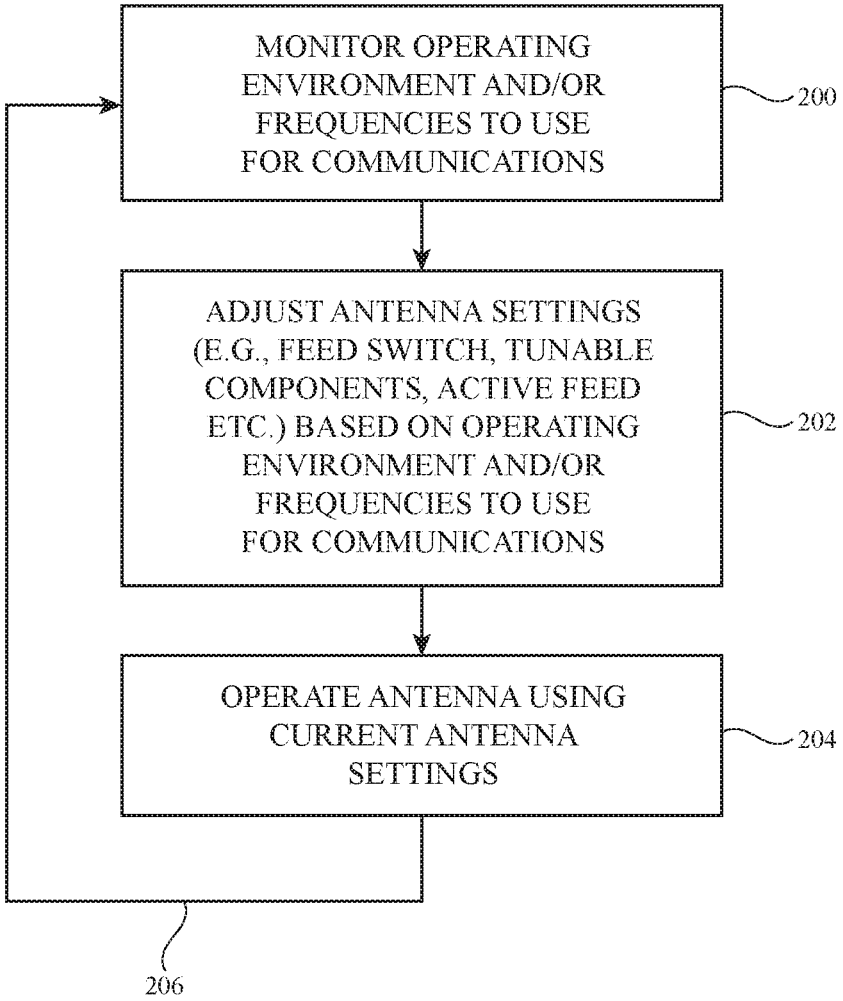
FIG. 8 is a flow chart of illustrative steps that may be involved in adjusting an antenna of the type shown in FIG. 7 in accordance with an embodiment.

FIG. 8 is a flow chart of illustrative steps involved in operating device 10 to ensure satisfactory performance for antenna 40-4 of FIG. 7 in all desired frequency bands of interest.

At step 200 of FIG. 8, storage and processing circuitry 28 may monitor the operating environment of device 10 and/or frequencies to use for performing wireless communications. The frequencies to use may be determined based on software running on storage processing circuitry 28 (e.g., software controlling wireless communications for device 10) and/or based on an assignment received from external equipment like a wireless base station.

Storage and processing circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as temperature sensors, capacitive proximity sensors, light-based proximity sensors, resistance sensors, force sensors, touch sensors, connector sensors that sense the presence of a connector in a connector port or that detect the presence or absence of data transmission through a connector port, sensors that detect whether wired or wireless headphones are being used with device 10, sensors that identify a type of headphone or accessory device that is being used with device 10 (e.g., sensors that identify an accessory identifier identifying an accessory that is being used with device 10), or other sensors to determine how device 10 is being used. Control circuitry 28 may also use information from an orientation sensor such as an accelerometer in device 10 to help determine whether device 10 is being held in a position characteristic of right hand use or left hand use (or is being operated in free space). Control circuitry 28 may also use information about a usage scenario of device 10 in determining how device 10 is being used (e.g., information identifying whether audio data is being transmitted through ear speaker 26 of FIG. 1, information identifying whether a telephone call is being conducted, information identifying whether a microphone on device 10 is receiving voice signals, etc.).

If desired, an impedance sensor or other sensor may be used in monitoring the impedance of antenna 40-4 or part of antenna 40-4. Different antenna loading scenarios may load antenna 40-4 differently, so impedance measurements may help determine whether device 10 is being gripped by a user's left or right hand or is being operated in free space. Another way in which storage and processing circuitry 28 may monitor antenna loading conditions involves making received signal strength measurements on radio-frequency signals being received with antenna 40-4. In this example, the adjustable circuitry of antenna 40-4 can be toggled between different settings and an optimum setting for antenna 40-4 can be identified by choosing a setting that maximizes received signal strength. In general, any desired combinations of one or more of these measurements or other measurements may be processed by storage and processing circuitry 28 to identify how device 10 is being used (i.e., to identify the operating environment of device 10).

At step 202, storage and processing circuitry 28 may adjust the configuration of antenna 40-4 (e.g., antenna settings for antenna 40-4) based on the current operating environment of device 10 and/or the frequencies to use for communications (e.g., based on data or information gathered while processing step 242). Storage and processing circuitry 28 may select a given one of feeds 112 and 112' to activate, may adjust the state of switch 156, may adjust component 176, and/or may adjust component 180 of FIG. 7 based on the information gathered while processing step 200 of FIG. 8.

At step 204, antenna 40-4 may be used to transmit and receive wireless data using the antenna settings selected at step 202. This process may be performed continuously, as indicated by path 206. In this way, antenna 40-4 may be dynamically adjusted in real time based on the operating environment and needs of device 10. Similar steps may be used to adjust antennas 40-1, 40-2, 40-3, and/or other antennas 40 in device 10 if desired.

Figure 9:
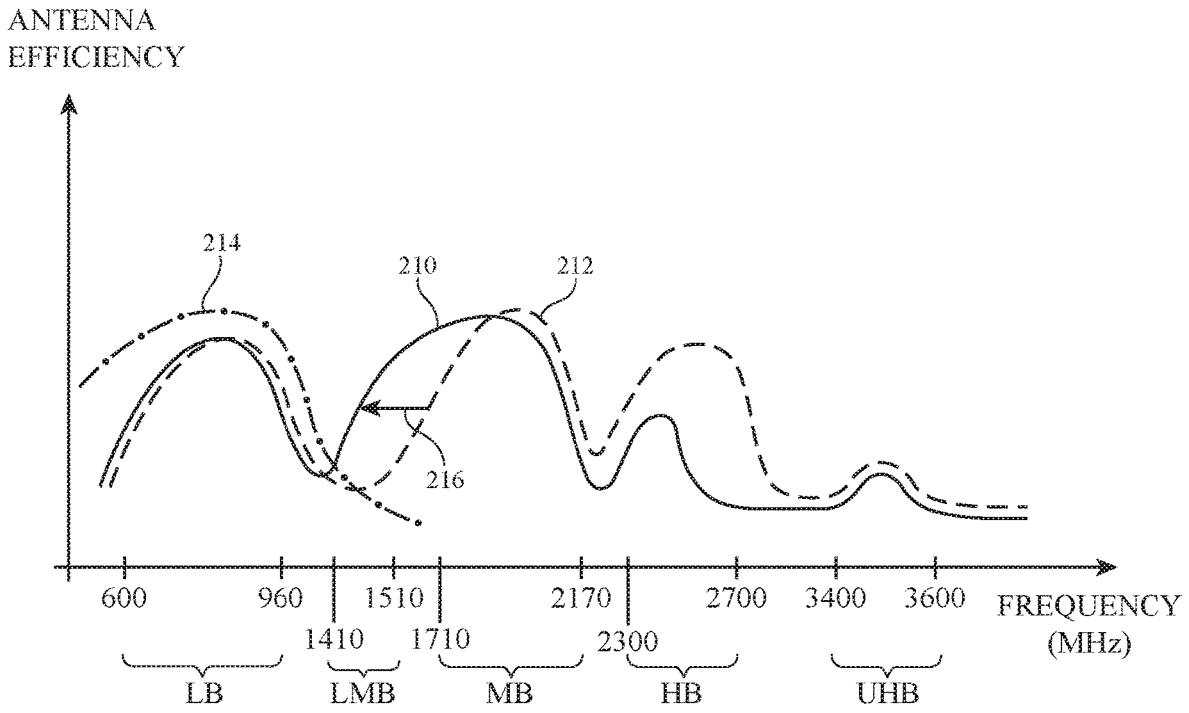
FIG. 9 is a plot of antenna performance (antenna efficiency) of an illustrative antenna of the type shown in FIG. 7 in accordance with an embodiment.

FIG. 9 is a graph in which antenna performance (antenna efficiency) has been plotted as a function of operating frequency for antenna 40-4 of FIG. 7. As shown in FIG. 9, curve 210 plots an exemplary antenna efficiency of antenna 40-4 while antenna feed 112 is active, antenna feed 112' is inactive, and switch 156 is turned off.

When placed in this configuration, the length of arm 132 between positive antenna feed terminal 98 and gap 18-3 may support a response peak in a first frequency band such as cellular low band LB (e.g., a frequency band between about 600 MHz and 960 MHz). The length of arm 132 between positive antenna feed terminal 98 and gap 18-2 may support a response peak that extends across a second frequency band such as cellular low-midband LMB (e.g., a frequency band between about 1410 MHz and 1510 MHz) and a third frequency band such as cellular midband MB (e.g., a frequency band between about 1710 MHz and 2170 MHz). End 192 of arm 132 may indirectly feed segment 160 of peripheral conductive housing structures 16 to support a response peak in a fourth frequency band such as cellular high band HB (e.g., a frequency band between about 2300 MHz and 2700 MHz). A harmonic mode of the portion of arm 132 between positive antenna feed terminal 98 and gap 18-2 may support a response peak in a fifth frequency band such as cellular ultra-high band UHB (e.g., a frequency band between about 3400 MHz and 3600 MHz).

As shown by curve 210, the response peak in cellular high band HB may only cover relatively low frequencies in cellular high band HB without providing satisfactory efficiency at higher frequencies in cellular high band HB. In order to cover the entirety of cellular high band HB with satisfactory efficiency, storage and processing circuitry 28 may turn on switch 156.

Curve 212 of FIG. 9 plots an exemplary antenna efficiency of antenna 40-4 while antenna feed 112 is active, antenna feed 112' is inactive, and switch 156 is turned on. Curve 212 also illustrates the efficiency of antenna 40-4 in scenarios where switch 156 is omitted and antenna feed 112 is active (while antenna feed 112' is inactive).

When placed in this configuration, vertical slot 190 is directly fed over positive antenna feed terminal 158 and signal conductor branch 154. This may serve to pull the coverage of antenna 40-4 in cellular high band HB to higher frequencies as well as to increase the overall efficiency of antenna 40-4 within cellular high band HB. Antenna 40-4 may thereby convey radio-frequency signals at higher frequencies within cellular high band HB with satisfactory antenna efficiency than in scenarios where transmission line 92-4 is only coupled to antenna 40-4 over a single positive antenna feed terminal 98 (as shown by curve 210 of FIG. 9).

Directly feeding vertical slot 190 as shown by curve 212 may also reduce antenna efficiency within the second frequency band (e.g., within cellular low-midband LMB). If desired, storage and processing circuitry 28 may adjust component 180 of FIG. 7 to pull the frequency response of antenna 40-4 downwards to also cover cellular low-midband LMB without substantially affecting coverage in cellular high band HB (as shown by arrow 216 of FIG. 9).

In order to further optimize antenna efficiency across low band LB, storage and processing circuitry 28 may activate antenna feed 112' and deactivate antenna feed 112 of FIG. 7. Curve 214 of FIG. 9 plots an exemplary antenna efficiency of antenna 40-4 while antenna feed 112' is active and antenna feed 112 is inactive. When placed in this configuration, a greater length of arm 132 is available for covering cellular low band LB than in scenarios where antenna feed 112 is used, thereby increasing the overall antenna efficiency and/or bandwidth for antenna 40-4 within cellular low band LB relative to the configurations associated with curves 210 and 212.

The example of FIG. 9 is merely illustrative. In general, antenna 40-4 may cover any desired bands at any desired frequencies (e.g., antenna 40-4 may exhibit any desired number of efficiency peaks extending over any desired frequency bands). Curves 210, 212, and 214 may have other shapes if desired.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a housing having peripheral conductive housing structures;

an antenna ground;

an antenna having an antenna resonating element arm formed from a segment of the peripheral conductive housing structures that is separated from the antenna ground by a dielectric-filled opening;

radio-frequency transceiver circuitry in the housing; and a radio-frequency transmission line comprising a ground conductor and a signal conductor coupled to the radio-frequency transceiver circuitry, wherein the ground conductor is coupled to a first terminal on the antenna ground and the signal conductor is coupled to second and third terminals on the peripheral conductive housing structures.

2. The electronic device defined in claim 1, further comprising:

a dielectric-filled gap in the peripheral conductive housing structures that separates the antenna resonating element arm from an additional segment of the peripheral conductive housing structures, wherein the second terminal is coupled to the antenna resonating element arm and the third terminal is coupled to the additional segment of the peripheral conductive housing structures.

3. The electronic device defined in claim 2, wherein a portion of the dielectric-filled opening extends between the additional segment of the peripheral conductive housing structures and the antenna ground.

4. The electronic device defined in claim 3, wherein antenna resonating element arm is configured to convey radio-frequency signals in a first frequency band and the portion of the dielectric-filled opening is configured to convey radio-frequency signals in a second frequency band that is higher than the first frequency band.

5. The electronic device defined in claim 4, wherein the signal conductor comprises a first branch coupled to the second terminal and a second branch coupled to the third terminal, the electronic device further comprising:

a switch interposed on the second branch of the signal conductor.

6. The electronic device defined in claim 5, wherein the switch has a first state at which an open circuit is formed between the first branch and the third terminal and a second state at which a short circuit path is formed between the first branch and the third terminal, the portion of the dielectric-filled opening being configured to convey the radio-frequency signals in the second frequency band when the switch is in the second state.

7. The electronic device defined in claim 6, wherein the additional segment is configured to convey the radio-frequency signals in the second frequency band when the switch is in the first state, the antenna resonating element arm being configured to indirectly feed the additional segment of the peripheral conductive housing structures via near-field electromagnetic coupling when the switch is in the first state.

8. The electronic device defined in claim 7, further comprising:

an adjustable component coupled between the antenna resonating element arm and the antenna ground, wherein the adjustable component is configured to tune a frequency response of the antenna in the first frequency band.

9. The electronic device defined in claim 8, further comprising:

an additional dielectric-filled gap in the peripheral conductive housing structures; and an additional radio-frequency transmission line coupled to a fourth terminal on the antenna ground and a fifth terminal on the antenna resonating element arm, wherein the fifth terminal is interposed between the additional-dielectric filled gap in the peripheral conductive housing structures and the second terminal.

10. The electronic device defined in claim 9, wherein the additional radio-frequency transmission line is configured to convey radio-frequency signals in a third frequency band that is lower than the first and second frequency bands, the antenna resonating element arm is configured to convey the radio-frequency signals in the third frequency band, and the electronic device further comprises:

control circuitry configured to selectively activate a given one of the radio-frequency transmission line and the additional radio-frequency transmission line.

11. The electronic device defined in claim 10, wherein the first frequency band comprises a first cellular telephone communications band between 1710 MHz and 2170 MHz, the second frequency band comprises a second cellular telephone communications band between 2300 MHz and 2700 MHz, and the third frequency band comprises a third cellular telephone communications band between 600 MHz and 960 MHz.

12. The electronic device defined in claim 10, further comprising an additional antenna having an additional antenna resonating element arm that is separated from the segment of the peripheral conductive housing structures by the additional dielectric-filled gap, wherein the control circuitry is configured to control the antenna and the additional antenna to perform radio-frequency communications at the same frequency using a multiple-input and multiple-output (MIMO) scheme.

13. The electronic device defined in claim 4, further comprising:

an adjustable component coupled between the antenna resonating element arm and the antenna ground, wherein the adjustable component is configured to tune a frequency response of the antenna in the first frequency band.

14. An electronic device comprising:

a housing having peripheral conductive structures;

a dielectric-filled gap in the peripheral conductive structures that divides the peripheral conductive structures into first and second segments;

an antenna ground;

a first slot that separates the antenna ground from the first segment;

a second slot that extends from an end of the first slot beyond an edge of the dielectric-filled gap in the peripheral conductive structures, wherein the second slot has edges defined by the antenna ground and the second segment of the peripheral conductive structures; and an antenna formed from the antenna ground, the first slot, the second slot, the first segment, and the second segment, wherein the antenna comprises an antenna feed having a ground antenna feed terminal coupled to the antenna ground, a first positive antenna feed terminal coupled to the first segment, and a second positive antenna feed terminal coupled to the second segment.

15. The electronic device defined in claim 14, further comprising:

radio-frequency transceiver circuitry; and a radio-frequency transmission line that has a signal conductor coupled between the antenna feed and the radio-frequency transceiver circuitry, wherein the signal conductor is coupled to the first positive antenna feed terminal over a first signal conductor branch and the signal conductor is coupled to the second positive antenna feed terminal over a second signal conductor branch.

16. The electronic device defined in claim 15, wherein the second signal conductor branch and the second positive antenna feed terminal are configured to directly feed the second slot and the second slot is configured to radiate radio-frequency signals in a first frequency band.

17. The electronic device defined in claim 16, further comprising:

an additional dielectric-filled gap in the peripheral conductive structures that separates the first segment from a third segment of the peripheral conductive structures, wherein the first segment comprises a first portion extending between the first positive antenna feed terminal and the dielectric-filled gap and a second portion extending between the first positive antenna feed terminal and the additional dielectric filled gap, the first portion of the first segment being configured to radiate radio-frequency signals in a second frequency band that is lower than the first frequency band, and the second portion of the first segment being configured to radiate radio-frequency signals in a third frequency band that is lower than the second frequency band.

18. The electronic device defined in claim 17, further comprising:

switching circuitry interposed on the second signal conductor branch, wherein the switching circuitry has a first state at which an open circuit is formed between the first signal conductor branch and the second positive antenna feed terminal and a second state at which a short circuit is formed between the first signal conductor branch and the second positive antenna feed terminal, the first portion of the first segment is configured to indirectly feed the second segment and the second segment is configured to radiate the radio-frequency signals in the first frequency band when the switching circuitry is in the first state, and the second slot is configured to radiate the radio-frequency signals in the first frequency band when the switching circuitry is in the second state.

19. An electronic device comprising:

a housing having peripheral conductive housing structures;

a dielectric-filled gap in the peripheral conductive housing structures that divides the peripheral conductive housing structures into first and second segments;

a radio-frequency transmission line having a signal conductor and a ground conductor; and an antenna, wherein the antenna comprises:

an antenna resonating element arm formed from the first segment;

an antenna ground separated from the first and second segments by a dielectric-filled opening; and an antenna feed having a ground antenna feed terminal on the ground conductor, a first positive antenna feed terminal on the first segment that is coupled to the signal conductor, and a second positive antenna feed terminal on the second segment that is coupled to the signal conductor.

20. The electronic device defined in claim 19, further comprising:

an additional radio-frequency transmission line coupled to an additional antenna feed having a third positive antenna feed terminal on the first segment and an additional ground antenna feed terminal on the antenna ground; and control circuitry configured to selectively activate a given one of the antenna feed and the additional antenna feed at a given time.

* * * * *